US005735201A

United States Patent [19]

Hirao et al.

[11] Patent Number: 5,735,201

[45] Date of Patent: Apr. 7, 1998

[54] APPARATUS INCLUDING MUTUALLY COMMUNICATING HYDRAULIC CYLINDERS FOR EVEN DISTRIBUTION OF BLANK-HOLDING FORCE ON PRESSING MACHINE

[75] Inventors: Norihisa Hirao, Okazaki; Kazunari Kirii, Aichi-ken; Munetaka Toda, Kariya, all of Japan

[73] Assignee: Toyota Jidosha Kabushiki Kaisha, Japan

[21] Appl. No.: 574,181

[22] Filed: Dec. 18, 1995

[30] Foreign Application Priority Data

Dec. 21, 1994 [JP] Japan ..... 6-318151
Aug. 14, 1995 [JP] Japan ..... 7-207113

[51] Int. Cl.[6] ..... B30B 15/02

[52] U.S. Cl. ..... 100/269.01; 72/351; 72/453.13; 100/269.14; 267/119

[58] Field of Search ..... 100/259, 269.01, 100/269.12, 269.14, 299; 72/453.13, 465, 351; 267/119

[56] References Cited

U.S. PATENT DOCUMENTS

| | | | |
|---|---|---|---|
| 1,503,131 | 7/1924 | Nelson | 267/119 |
| 1,970,134 | 8/1934 | Ferris | 267/119 |
| 2,300,162 | 10/1942 | Maude | 72/351 |
| 3,268,220 | 8/1966 | Williamson | 267/119 |
| 3,914,978 | 10/1975 | Sekanina et al. . | |
| 4,056,965 | 11/1977 | Heiser . | |
| 4,499,750 | 2/1985 | Gerber et al. . | |
| 4,592,220 | 6/1986 | Martinez et al. . | |
| 4,635,446 | 1/1987 | Meckler . | |
| 4,635,466 | 1/1987 | Seki et al. | 100/259 |
| 4,669,298 | 6/1987 | Kono et al. . | |
| 4,821,552 | 4/1989 | Baur et al. . | |
| 5,003,807 | 4/1991 | Terrell et al. . | |
| 5,299,444 | 4/1994 | Kirii et al. | 100/259 |
| 5,311,910 | 5/1994 | Hasegawa et al. . | |
| 5,457,980 | 10/1995 | Kirii et al. | 72/453.13 |

FOREIGN PATENT DOCUMENTS

| | | |
|---|---|---|
| 2046914 | 6/1991 | Canada . |
| 0 312 809 | 4/1989 | European Pat. Off. . |
| 55-97819 | 7/1980 | Japan . |
| 1-249227 | 10/1989 | Japan . |
| 5-57362 | 3/1993 | Japan . |

OTHER PUBLICATIONS

Patent Abstracts of Japan, vol. 18, No. 538, (M-1686), Jul. 12, 1994, JP6190464.

*Primary Examiner*—Stephen F. Gerrity
*Attorney, Agent, or Firm*—Finnegan, Henderson, Farabow, Garrett & Dunner, L.L.P.

[57] ABSTRACT

A balancing apparatus for a pressing machine, including a force generating device for generating a force during a pressing operation on a blank, and a plurality of balancing hydraulic cylinders which have respective oil chambers communicating with each other and which include respective pistons that are moved to neutral positions thereof during the pressing operation, for evenly distributing said force, and where a discharge control device is connected to a connecting passage connecting the oil chambers of the balancing hydraulic cylinders to each other, so that the discharge control device inhibits a discharge flow of a working fluid from the hydraulic cylinders and thereby holding the pistons of all of the hydraulic cylinders at upper stroke ends thereof, prior to the pressing operation, and permits the discharge flow of the working fluid to thereby permit the pistons to be moved to the neutral positions during the pressing operation.

19 Claims, 5 Drawing Sheets

APPARATUS INCLUDING MUTUALLY COMMUNICATING HYDRAULIC CYLINDERS FOR EVEN DISTRIBUTION OF BLANK-HOLDING FORCE ON PRESSING MACHINE

BACKGROUND OF THE INVENTION

1. Field of the Invention

The present invention relates in general to a balancing apparatus provided on a pressing machine and including a plurality of balancing hydraulic cylinders whose oil chambers communicate with each other and whose pistons are held in their neutral positions for even distribution of a blank-holding force, and more particularly to such a balancing apparatus which permits even distribution of the blank-holding force without an influence of the temperature of a working fluid or oil in the hydraulic cylinders and air mixed in the fluid.

2. Discussion of the Related Art

For even distribution of a blank-holding force for holding a blank on a pressing machine, there is known a balancing apparatus equipped with a plurality of balancing hydraulic cylinders whose oil chambers communicate with each other and whose pistons are held at their neutral positions during a pressing operation on the blank so that the blank-holding force is uniformly transmitted to the blank through the balancing hydraulic cylinders. An example of such a balancing apparatus is disclosed in JP-A-5-57362 (published in 1993). This balancing apparatus includes (a) force generating means for generating a blank-holding force, (b) a cushion platen connected to the force generating means so as to receive the blank-holding force, (c) a plurality of balancing hydraulic cylinders disposed on the cushion platen and having respective oil chambers which communicate with each other, (d) a pressure member for holding a blank, and (e) a plurality of cushion pins associated at their lower ends with pistons of the hydraulic cylinders and supporting at their upper ends the pressure member. During a pressing operation on the blank, the pistons of the hydraulic cylinders are moved to their neutral positions with the working fluid being elastically compressed by the blank-holding force, so that the blank-holding force is evenly transmitted to the cushion pins through the hydraulic cylinders for even distribution of the blank-holding force over the blank, even in the presence of some variation in the length dimensions of the cushion pins and an inclination of the cushion platen relative to the horizontal plane.

For even distribution of the blank-holding force during a pressing operation on the blank, the pistons of all of the balancing hydraulic cylinders should be held in the neutral positions, namely, between the upper and lower stroke ends without bottoming at the lower stroke ends, irrespective of some fluctuating factors such as a variation in the length dimensions of the cushion pins from the nominal value. To this end, an optimum initial hydraulic pressure Psso in the hydraulic cylinders is calculated so as to satisfy the following equation (1), for example.

$$Xav=(Fso-n\cdot As\cdot Psso)V/n^2\cdot As^2\cdot K \quad (1)$$

where,

Xav: Operating stroke between the upper stroke end and neutral position of the pistons of the hydraulic cylinders;

As: Pressure-receiving area of the pistons;

K: Modulus of elasticity of volume of the working fluid;

V: Volume of the working fluid;

Fso: Optimum blank-holding force; and n: Number of the cushion pins.

An actual initial hydraulic pressure Pss in the hydraulic cylinders prior to the pressing operation is adjusted to the thus calculated optimum value Psso. The operating stroke Xav is an average of the distances of movements of all pistons from their upper stroke ends to the neutral position, which distances are necessary for abutting contact of the cushion pins with the pressure member and do not cause any pistons to reach the lower stroke ends, even in the presence of some length variation of the cushion pins and some inclination of the cushion platen. The average distance Xav is determined taking into account the length variation of the cushion pins, maximum operating stroke of the pistons, etc. The volume V of the working fluid is the total volume of a hydraulic circuit including the oil chambers of all the hydraulic cylinders and a connecting passage communicating with the oil chambers. The volume of each oil chamber is the volume when the piston is located at its upper stroke end. The optimum blank holding force Fso and the number n of the cushion pins are determined, for each die set, by test pressing operations, so as to attain the desired quality of a product from the blank using the die set.

It was found, however, that the adjustment of the initial hydraulic pressure Pss in the balancing hydraulic cylinders according to the above equation (1) will not necessarily provide even distribution of the blank-holding force through the cushion pins, because the compressibility of the working fluid, that is, the modulus K of elasticity of volume of the working fluid varies with its temperature and an amount of air mixed with the oil. The conventional balancing apparatus described above inevitably suffers from this problem, since the principle of operation of the conventional apparatus is based on the compression of the working fluid, namely, the apparatus is designed on the assumption that the working fluid consists of an oil and air inevitably mixed with the oil, that is, some amount of air is present in the working fluid. To deal with this problem, the initial hydraulic pressure Pss adjusted according to the above equation (1) should be re-adjusted as needed by effecting trial or test pressing operations after the initial adjustment of the initial hydraulic pressure Pss.

SUMMARY OF THE INVENTION

It is therefore an object of the present invention to provide a balancing apparatus which assures even distribution of a force without influences of the varying temperature of the working fluid and air mixed with the oil.

The above object may be achieved according to the principle of the present invention, which provides a balancing apparatus for a pressing machine, including force generating means for generating a force during a pressing operation, and a plurality of balancing hydraulic cylinders which have respective oil chambers communicating with each other and which include respective pistons that are moved to neutral positions thereof during the pressing operation, for evenly distributing the force, the balancing apparatus comprising: a connecting passage connecting the oil chambers of the balancing hydraulic cylinders to each other, and discharge control means connected to the connecting passage, for inhibiting, prior to the pressing operation, a discharge flow of a working fluid from the balancing hydraulic cylinders and thereby holding the pistons of all of the balancing hydraulic cylinders at upper stroke ends thereof, and for permitting, during the pressing operation, the discharge flow of the working fluid to thereby permit the pistons to be moved to the neutral positions.

In the balancing apparatus of the present invention constructed as described above, the pistons of the balancing hydraulic cylinders are moved to the neutral positions with the working fluid discharged into the discharge control means through the connecting passage. Thus, the present balancing apparatus is capable of establishing the neutral positions of the pistons of the hydraulic cylinders, without utilizing the compressibility of the working fluid. Therefore, the present apparatus assures even distribution of the force such as the blank-holding force, without an influence of the varying temperature of the working fluid or the varying amount of air present in the working fluid, if the hydraulic pressure in the balancing hydraulic cylinders is set to be a relatively high level at which the compressibility of the working fluid is substantially constant regardless of the temperature of the working fluid and the amount of air present therein, or if the initial volume of the working fluid prior to a pressing operation is made small enough to permit a relatively large amount of change of the hydraulic pressure in the balancing hydraulic cylinders with a relatively small amount of change of the working fluid volume.

In the balancing apparatus of the present invention, the discharge control means inhibits the discharge flow of the working fluid from the balancing hydraulic cylinders through the connecting passage, during adjustment of the initial hydraulic pressure in the balancing hydraulic cylinders prior to a pressing operation on the blank. In this adjustment, the initial hydraulic pressure is set to be a relatively high level at which the compressibility of the working fluid is substantially constant regardless of the temperature of the working fluid and the amount of air present mixed with the oil. During the pressing operation in which the hydraulic pressure in the balancing hydraulic cylinders is raised, the discharge control means permits the working fluid to be discharged from the balancing hydraulic cylinders by a predetermined amount through the connecting passage, so that the pistons of all of the balancing hydraulic cylinders are moved to the neutral positions at which the pressing operation can be performed with the force being evenly distributed irrespective of the varying temperature of the working fluid and the varying amount of the air present therein. On the other hand, the conventional balancing apparatus utilizes the compressibility of the working fluid, and is operated on the assumption that some amount of air is mixed in the working fluid (mixed with the oil). In the conventional apparatus, the pistons are moved to the neutral positions without the working fluid being discharged from the balancing hydraulic cylinders. Therefore, the conventional apparatus requires the initial hydraulic pressure to be set at a relatively low level at which the modulus of elasticity of volume of the working fluid is comparatively low in the presence of air in the working fluid. In this conventional arrangement, the compressibility of the working fluid varies with the amount of air mixed with the oil. A variation in the compressibility of the working fluid may cause a variation in the neutral positions of the pistons of the balancing hydraulic cylinders, leading to uneven distribution of the force. In the present balancing apparatus, to the contrary, the neutral positions of the balancing hydraulic cylinders are established by the discharge flow of the working fluid from these hydraulic cylinders. Thus, the present apparatus does not require the compressibility of the working fluid, but is adapted to set the initial hydraulic pressure to be a high level at which the compressibility of the working fluid is substantially constant and the generated force is evenly distributed, irrespective of the varying temperature of the fluid and the varying amount of the air present therein.

Explained more specifically, if the initial hydraulic pressure in the balancing hydraulic cylinders is set to be substantially equal to the pressure corresponding to the force transmitted through the hydraulic cylinder (pressure during the pressing operation), there arises substantially no increase of the pressure in the hydraulic cylinders from the initial level to the level during the pressing operation, and the change of the volume of the working fluid can be ignored. Therefore, the force generated by the force generating means can be evenly distributed by the balancing hydraulic cylinders irrespective of the compressibility of the working fluid, with the working fluid being discharged from the hydraulic cylinders by an amount necessary to permit the pistons of the hydraulic cylinders to be moved to the neutral positions. If the initial hydraulic pressure is set to be a level of about $80\times9.8\times10^4$ Pa (=80 kgf/cm$^2$) or higher, for example, the air present in the working fluid is substantially completely dissolved in the oil, and the modulus of elasticity of volume of the working fluid is as high as about 16000. In this condition in which the working fluid can be considered to be almost non-compressible, the amount of change of the volume of the working fluid, namely, the compressibility of the working fluid can be ignored in determining or setting the amount of discharge flow of the working fluid from the hydraulic cylinders, even where the initial hydraulic pressure is more or less lower than the pressure during the pressing operation. In other words, the amount of change of the volume of the working fluid due to a change in the pressure in the hydraulic cylinders is extremely small because the modulus of elasticity of volume of the working fluid is extremely high. In this condition, even distribution of the force can be established over a relatively wide range of the average operating stroke of the pistons of the hydraulic cylinders. This means that the balancing hydraulic cylinders assure even distribution of the force, even if the amount of change of the fluid volume is ignored in the above case. However, it is noted that the amount of change of the fluid volume increases with an increase in the difference between the initial hydraulic pressure and the pressure during the pressing operation. In this respect, it is desirable to take the compressibility of the working fluid into account in determining the amount of discharge flow of the working fluid from the hydraulic cylinders. In this case, the amount of discharge flow of the working fluid can be determined with further improved accuracy, since the compressibility of the working fluid at the initial hydraulic pressure of about $80\times9.8\times10^4$ Pa or higher is substantially constant irrespective of the varying amount of air present in the fluid and the varying temperature of the fluid.

If the initial volume of the working fluid prior to the pressing operation is set to be relatively small, the amount of change of the hydraulic pressure in the hydraulic cylinders per unit amount of change of the fluid volume (i.e., per unit distance of movement of the pistons) is relatively large. In this case, therefore, a relatively small amount of change of the piston positions of the hydraulic cylinders permits even distribution of the force, while preventing the bottoming of the pistons, even in the presence of some variation in the compressibility of the working fluid due to the varying temperature of the fluid and the varying amount of air mixed therein. In this case, it is not necessary to set the initial hydraulic pressure to be high as required in the above case. Instead, the balancing apparatus is designed such that the initial volume of the working fluid in the balancing hydraulic cylinders and the connecting passage is small enough to permit the pistons of the hydraulic cylinders to be moved to the neutral positions for even distribution of the force without bottoming of the pistons, owing to the suitable amount of discharge flow of the working fluid from the hydraulic cylinders through the connecting passage, regardless of some variation in the compressibility of the working fluid due to the variation in the temperature of the fluid and the amount of air mixed therein. This arrangement allows some variation in the initial hydraulic pressure as well as some variation in the compressibility of the working fluid, and therefore does not require an intricate control of the initial hydraulic pressure upon each pressing operation. Where the initial volume of the working fluid is designed to be small, it is not necessary to stringently or accurately control the initial hydraulic pressure, even if the initial hydraulic pressure is set to be relatively high.

The force generating means may be a cushioning pneumatic cylinder adapted to generate a blank-holding force for holding the blank during a pressing operation. In this case, the balancing hydraulic cylinders operate to evenly distribute the blank-holding force. This blank-holding force increases with an increase in the operating or cushioning stroke of the pneumatic cylinder. The hydraulic pressure in the balancing hydraulic cylinders is raised with an increase in the blank-holding force, and the pistons of the hydraulic cylinders are moved toward the lower stroke ends. Where the initial volume of the working fluid is set to be small as indicated above, the amount of reduction of the volume of the working fluid which is inversely proportional to the amount of increase of the blank-holding force is relatively small. Accordingly, the distances of movement of the pistons of the hydraulic cylinders toward the lower stroke ends are considerably small, and therefore the axial dimension of the hydraulic cylinders can be made comparatively small while the pistons are prevented from bottoming during operation of the hydraulic cylinders.

In a first preferred form of the present invention, the discharge control means comprises a plurality of discharge control cylinders which are disposed in parallel connection with each other and which are connected to the connecting passage. Each of the discharge control cylinders includes a piston and elastic means for producing a biasing force for biasing the piston so as to hold the piston at an original position thereof prior to the pressing operation. The piston receives a hydraulic pressure in the balancing hydraulic cylinders through the connecting passage so that the piston is moved from the original position against a biasing force of the elastic means when the hydraulic pressure is raised during the pressing operation, whereby the discharge control cylinders permit the discharge flow of the working fluid from the balancing hydraulic cylinders into the discharge control cylinders through the connecting passage, by an amount corresponding to a distance of movement of the piston from the original position, during the pressing operation.

In the balancing apparatus according to the above form of the invention, the working fluid is automatically discharged from and returned into the balancing hydraulic cylinders, on the basis of the biasing force produced by the elastic means. Accordingly, the apparatus as a whole including a control portion can be comparatively simple and inexpensive. Further, the use of the two or more discharge control cylinders as the discharge control means makes it possible to reduce the required operating stroke of each discharge control cylinder and accordingly reduce the axial dimension of the discharge control means if the cylinders are arranged in a plane.

In the first preferred form of the balancing apparatus of the present invention, each of the plurality of discharge control cylinders has suitable elastic means for producing a biasing force for biasing the piston so as to hold the piston at the original position during adjustment of the initial hydraulic pressure in the balancing hydraulic cylinders prior to a pressing operation on the blank. With the piston held at the original position, the discharge flow of the working fluid from the balancing hydraulic cylinders is inhibited. During the pressing operation, the piston is moved or retracted from the original position against the biasing force of the elastic means, so that the working fluid is discharged from the balancing hydraulic cylinders into the discharge control cylinders through the connecting passage, by an amount corresponding to the distance of movement of the pistons of the discharge control cylinders from their original positions. Consequently, the pistons of the balancing hydraulic cylinders are moved to the suitable neutral position that assure even distribution of the force generated by the force generating means. Since the two or more discharge control cylinders are provided, the distance of movement of the piston of each discharge control cylinder from the original position during the pressing operation is relatively small. Therefore, the axial dimension of the discharge control cylinders can be made smaller than that of a single discharge control cylinder used as the discharge control means. Thus, the discharge control cylinders can be installed in a relatively small space having a relatively small height. In this sense, the present form of the invention has a higher degree of freedom in the location of the discharge control means (discharge control cylinders). Described more specifically, it is desirable that the piston of the discharge control means be held at the original position by a relatively small biasing force. To this end, it is desirable to reduce the pressure-receiving area of the piston of the discharge control means which receives the hydraulic pressure in the balancing hydraulic cylinders. On the other hand, the piston is required to be moved from the original position by a distance large enough to permit the predetermined amount of the working fluid to be discharged from the balancing hydraulic cylinders. Hence, if a single discharge control cylinder is used as the discharge control means, the piston of this cylinder should have a relatively large operating stroke. According to the present first preferred form of the invention wherein the discharge control means comprises a plurality of discharge control cylinders, the required operating stroke of the piston of each cylinder is considerably reduced, for example, one half or one third of that of the single discharge cylinder used as the discharge control means, if two or three discharge control cylinders are used in this form of the invention. Although the operating stroke of the piston can be reduced by increasing the pressure-receiving surface area of the piston which receives the hydraulic pressure, there is a limitation in the maximum pressure-receiving surface area, since an increase in the pressure-receiving surface area results in an accordingly increased load acting on the piston and cylinder housing, and requires the single discharge control cylinder to have an accordingly increased mechanical strength, which requires the cylinder to have increased size and weight.

The elastic means used for biasing the piston of each discharge control cylinder may be selected from among: an elastic member such as a spring and a rubber member; and an elastic medium such as compressed air or gas, and a gel having a comparatively low modulus of elasticity of volume. The biasing force produced by such elastic means is determined such that the biasing force is sufficient to hold the piston of the discharge control cylinder at the original position against the hydraulic pressure acting on the piston, during adjustment of the initial hydraulic pressure in the balancing hydraulic cylinders prior to the pressing operation, but is small enough to permit the piston to be moved from the original position when the hydraulic pressure is raised during the pressing operation in which a load acts on the hydraulic cylinders. It is desirable that the initial biasing force produced by the elastic means be adjustable by suitable biasing force adjusting means, which is adapted to change the amount of elastic deformation of an elastic member as the elastic means, or change the initial pressure of compressed air or gas as the elastic means. It is also desirable that the initial hydraulic pressure in the balancing hydraulic cylinders be adjusted to a level lower than the pressure which corresponds to the force generated by the force generating means during the pressing operation, for example, the pressure which is generated when the press slide is located at its lower stroke end. For instance, the initial hydraulic pressure is adjusted to a level in the neighborhood of $80\times9.8\times10^4$ Pa. The initial hydraulic pressure may be adjusted by pressure regulating means which includes a pump, a pressure control valve and a check valve, for example. Where the initial volume of the working fluid in the balancing hydraulic cylinders and connecting passage is relatively small, the initial hydraulic pressure may be set at a relatively low level around the atmospheric pressure. Where the initial working fluid volume is relatively small, it is not necessary to accurately control the initial hydraulic pressure, regardless of whether the initial hydraulic pressure is set to be relatively high or relatively low. The distance of movement of the piston of each discharge control cylinder from the original position may be defined by a suitable positioning member or stopper such as a screw. However, each discharge control cylinder may be arranged such that the piston is moved to a position of equilibrium between the biasing force which increases with an increase in the amount of deformation of the elastic means and a force based on the hydraulic pressure which corresponds to the force generated by the force generated means during the pressing operation. If a stopper is used to stop the piston at a predetermined position away from the original position, it is not necessary to accurately control the initial biasing force of the elastic means.

The plurality of discharge control cylinders are disposed in parallel connection with each other, and each of these cylinders is connected at one of two fluid chambers to the connecting passage. However, the other ends of the discharge control cylinders need not be connected to each other, contrary to the definition of "parallel connection" as used in electrics. The other fluid chambers may be charged or supplied with a compressed gas. For facilitating the adjustment of the gas pressures in the cylinders, it is desirable to connect these other fluid chambers of the discharge control cylinders to each other.

In a second preferred form of this invention, the discharge control means comprises at least one discharge control cylinder connected to the connecting passage. Each discharge control cylinder includes a piston and elastic means for producing a biasing force for biasing the piston so as to hold the piston at an original position thereof prior to the pressing operation. The piston receives a hydraulic pressure in the balancing hydraulic cylinders through the connecting passage so that the piston is moved from the original position against a biasing force of the elastic means when the hydraulic pressure is raised during the pressing operation. The piston is moved to a position of equilibrium between the biasing force which increases as the elastic means is elastically deformed during a movement of the piston from the original position and a force based on the hydraulic pressure which corresponds to the force generated by the force generating means. The at least one discharge control cylinder permits the discharge flow of the working fluid from the balancing hydraulic cylinders into the at least one discharge control cylinder through the connecting passage, by an amount corresponding to a distance of the movement of the piston from the original position, during the pressing operation.

The balancing apparatus according to the above second preferred form of the invention is also simple and inexpensive owing to the automatic flows of the working fluid from and into the balancing hydraulic cylinders on the basis of the biasing force produced by the elastic means. In addition, the present apparatus is less likely to suffer from pulsation or abrupt change of the hydraulic pressure during the pressing operation, which would cause a change in the load acting on the balancing hydraulic cylinders and resulting deterioration of quality of the products manufactured by the pressing machine.

In the balancing apparatus according to the second preferred form of the invention, the discharge control means comprises at least one discharge control cylinder each having a piston and elastic means. As in the first preferred form of the invention, the biasing means of each discharge control cylinder produces a biasing force for biasing the piston so as to hold the piston at the original position during adjustment of the initial hydraulic pressure in the balancing hydraulic cylinders prior to a pressing operation on the blank. With the piston held at the original position, the discharge flow of the working fluid from the balancing hydraulic cylinders is inhibited. During the pressing operation, the piston is moved or retracted from the original position against the biasing force of the elastic means, to a position of equilibrium between the biasing force which increases with an increase in the amount of elastic deformation of the elastic means during a movement of the piston from the original position and a force based on the hydraulic pressure which corresponds to the force generated by the force generating means. Thus, the working fluid is discharged from the balancing hydraulic cylinders into the discharge control cylinders through the connecting passage, by an amount corresponding to the distance of movement of the pistons of the discharge control cylinders from their original positions. Consequently, the pistons of the balancing hydraulic cylinders are moved to the suitable neutral positions at which the force generated by the force generating means is evenly distributed. The working fluid is discharged from the balancing cylinders into the at least one discharge control cylinder, with the piston of each cylinder being retracted until the hydraulic pressure in the balancing hydraulic cylinders is raised to a level which corresponds to the nominal force that should be generated by the force generating means, for example, a level corresponding to the desired blank-holding force. Compared with a balancing apparatus wherein the piston of the discharge control cylinder is stopped at a predetermined position by a stopper, the present balancing apparatus is less likely to suffer from pulsation or abrupt change of the hydraulic pressure, and a resulting variation in the load acting on the balancing hydraulic cylinders, and is therefore effective to avoid deterioration of quality of a product produced by the pressing operation, which deterioration would arise from the variation in the load.

As in balancing apparatus according to the first preferred form of the invention, the elastic means used in the present second preferred form of the invention may be a spring, a rubber member or other elastic member, compressed air or gas, or a gel having a comparatively low modulus of elasticity of volume. The biasing force produced by the elastic means is determined so as to hold the piston of the corresponding discharge control cylinder at the original position against the hydraulic pressure during adjustment of the initial hydraulic pressure prior to a pressing operation, and so as to permit the piston to be retracted from the original position when the hydraulic pressure in the balancing hydraulic cylinders is raised during the pressing operation in which the load acting on the hydraulic cylinders is increased. The piston is moved to the position of equilibrium between the biasing force which increases as the elastic means is elastically deformed and the force based on the hydraulic pressure which corresponds to the force generated by the force generating means. The neutral positions of the pistons of the balancing hydraulic cylinders correspond to the position of equilibrium indicated above. The biasing force of the elastic means may be determined according to suitable equations which include suitable parameters such as: pressure-receiving area of the balancing hydraulic cylinders; number of the hydraulic cylinders used for a pressing operation; volume of the working fluid in the hydraulic system including the oil chambers of the hydraulic cylinders and the connecting passage; initial hydraulic pressure in the hydraulic cylinders; optimum or desired average operating stroke of the pistons of the hydraulic cylinders; pressure-receiving area of the piston of each discharge control cylinder, which receives the hydraulic pressure; modulus of elasticity of the elastic means; initial biasing force of the elastic means; and optimum or nominal force to be generated by the force generating means. The initial biasing force of the elastic means and the initial hydraulic pressure in the balancing hydraulic cylinders are desirably adjusted by such biasing force adjusting means and pressure regulating means as described above with respect to the first preferred form of the invention. Where the initial volume of the working fluid is relatively small, the initial hydraulic pressure need not be accurately controlled, regardless of whether the initial hydraulic pressure is high or low.

In one advantageous arrangement of the above second preferred form of the invention, the at least one discharge control cylinder provided as the discharge control means consists of a plurality of discharge control cylinders which are disposed in parallel connection with each other. These cylinders have respective different relationships between the biasing force produced by the elastic means and the force based on the hydraulic pressure. In the present arrangement, the balancing apparatus further comprises selecting means for selectively enabling the plurality of discharge control cylinders to be operative, and the individual cylinders are connected in parallel to the connecting passage through the selecting means.

The above advantageous arrangement can be readily adapted to a specific one of different pressing conditions, by suitably controlling the selecting means to enable the corresponding combination of the discharge control cylinders in the operative state. Described in detail, the individual discharge control cylinders having the different relationships between the biasing force and the force based on the hydraulic pressure are connected in parallel to the connecting passage through the selecting means. In the present arrangement, the amount of change of the hydraulic pressures in the balancing hydraulic cylinders with respect to unit amount of discharge flow of the working fluid from the hydraulic cylinders through the connecting passage into the discharge control cylinders can be changed by selectively enabling the discharge control cylinders by operating the selecting means. For instance, the appropriate discharge control cylinders are selected to move the pistons of the balancing hydraulic cylinders to the neutral position, while holding the amount of discharge flow of the fluid substantially constant irrespective of a change in the hydraulic pressure during the pressing operation, which pressure corresponds to the nominal force to be generated by the force generating means. Alternatively, the appropriate discharge control cylinders are selected so as to establish the hydraulic pressure corresponding to the nominal force, irrespective of a change in the number of the balancing hydraulic cylinders used for a given pressing operation, which change will cause a change in the amount of discharge flow of the fluid necessary to move the pistons of the hydraulic cylinders to the neutral positions. Thus, the mere manipulation or control of the selecting means makes it possible to easily deal with different pressing conditions of the machine.

Where the elastic means is a compressed gas, the relationship between the biasing force produced by the elastic means and the force based on the hydraulic pressure can be made different between the individual discharge control cylinders, by changing the ratio of the pressure-receiving surface areas of the piston which receive the hydraulic pressure and the pressure of the compressed gas, or the initial pressure or volume of the compressed gas which fills a gas chamber of the cylinder. Where the elastic means is an elastic member such as a spring, the relationship can be made different by changing the pressure-receiving surface area which receives the hydraulic pressure, or the modulus of elasticity or initial amount of deformation of the elastic member. The selecting means is adapted to selectively connect or disconnect each of the discharge control cylinders to or from the connecting passage. The selecting means may preferably include solenoid-operated shut-off valves connected to the oil chambers of the respective discharge control valves.

In a third preferred form of the present invention, the discharge control means comprises a discharge control cylinder device and biasing means connected to the discharge control cylinder device. The discharge control cylinder device includes a cylinder body, and a stepped piston which is slidably movably received within the cylinder body and which has a large-diameter portion and a small-diameter portion. The large-diameter portion cooperates with the cylinder body to define a first chamber communicating with the connecting passage, while the cylinder body cooperates with at least the small-diameter portion to define a second chamber filled with a control fluid, which biases the stepped piston toward the first chamber so as to hold the stepped piston at an original position thereof prior to the pressing operation. The cylinder body has a hole which communicates at one end thereof with the second chamber when the stepped piston is placed in the original position. The hole is closed at the one end by the small-diameter portion when the stepped piston is moved by a predetermined distance from the original position toward the second chamber. The biasing means is connected at the other end of the hole for introducing the control fluid into the second chamber through the hole so as to hold the stepped piston at the original position prior to the pressing operation. The biasing means permits the stepped piston to be moved from the original position against a biasing force of the control fluid when a hydraulic pressure in the balancing hydraulic cylinders is raised during the pressing operation. The biasing means absorbs a portion of the control fluid discharged from the second chamber through the hole during a movement of the stepped piston from the original position.

The above third preferred form of the invention provides substantially the same advantages as the apparatus according to the second preferred form of the invention discussed above.

In the balancing apparatus according to the third preferred form of the invention, the stepped piston of the discharge control cylinder device is held at the original position, prior to a pressing operation, under the biasing force of the biasing means, and the discharge flow of the working fluid from the balancing hydraulic cylinders is inhibited. During the pressing operation in which the hydraulic pressure in the balancing hydraulic cylinders is raised, the stepped piston is moved from the original position against the biasing force of the biasing means, with the working fluid being discharged from the hydraulic cylinders through the connecting passage into the first chamber. With the stepped piston moved by the predetermined distance, the small-diameter portion of the stepped piston enters the hole and thereby closes the hole at its one end adjacent the second chamber, a further movement of the stepped piston toward the second chamber is inhibited by the increased pressure of the control fluid in the second chamber, whereby a further amount of discharge flow of the fluid from the balancing hydraulic cylinders into the first chamber is inhibited. Thus, the pistons of the balancing hydraulic cylinders are moved to the neutral positions for even distribution of the force, by the predetermined amount of discharge flow of the working fluid from the hydraulic cylinders. After the stepped piston has been moved by the predetermined distance, a further movement of the stepped piston is prevented by the increased pressure of the control fluid in the second chamber. This arrangement is effective to minimize pulsation or abrupt change of the hydraulic pressure, and consequent variation in the load acting on the hydraulic cylinders, and is therefore effective to prevent deterioration of quality of the products manufactured by the pressing machine, which would occur in a balancing apparatus wherein the piston of the discharge control cylinder device is stopped at a predetermined position by a mechanical stopper.

The biasing means may be a biasing cylinder device having two chambers one of which is filled with the control fluid and is connected to the second chamber of the discharge control cylinder device through the hole. The other chamber of the biasing cylinder device has suitable elastic means such as an elastic member such as a spring or rubber member, compressed air or gas, or a gel having a comparatively low modulus of elasticity of volume. With the piston of the biasing cylinder device being reciprocated, the control fluid is introduced into or discharged from the second chamber of the discharge control cylinder device. The control fluid may be the same as the working fluid used for the balancing hydraulic cylinders, but may be other liquid or gas. Preferably, the initial biasing force of the biasing means and the initial hydraulic pressure in the balancing hydraulic cylinders are adjusted by suitable biasing force adjusting means or pressure regulating means as indicated above with respect to the first and second preferred forms of the invention. The initial biasing force need not be accurately adjusted, provided this initial biasing force permits the stepped piston to be moved during the pressing operation, to a position at which the hole of the discharge control cylinder device is closed by the small-diameter portion of the stepped piston. Where the initial volume of the working fluid is relatively small, the initial hydraulic pressure need not be accurately controlled regardless of whether the initial hydraulic pressure is relatively high or low.

In a further formed of this invention, the discharge control means comprises a plurality of discharge control cylinders which have respective stop members for stopping their pistons at predetermined positions corresponding to the neutral positions of the balancing hydraulic cylinders. These discharge control cylinders may be connected to the connecting passage through suitable selecting means as described above. In this case, the amount of the discharge flow of the working fluid from the balancing hydraulic cylinders can be changed by changing the number of the discharge control cylinders which are enabled by the selecting means. Thus, the present arrangement is capable of dealing with different pressing operations to be performed by using different numbers of the balancing hydraulic cylinders.

The discharge control means may comprise a suitable device including a pressure relief valve or shut-off valve through which the working fluid is discharged from the balancing hydraulic cylinders by a predetermined amount, and a flow meter for measuring an amount of flow of the fluid discharged through the relief vale or shut-off valve. Alternatively, the discharge control means may comprise a device including feed screws for moving the piston or pistons of the discharge control valve or valves as described above, by a predetermined distance corresponding to the desired amount of discharge flow of the fluid from the balancing hydraulic cylinders.

The working fluid may be discharged from the balancing hydraulic cylinders at any time after the pistons of all the hydraulic cylinders are once moved to the upper stroke ends by adjustment of the initial hydraulic pressure, for example, and during or before a pressing action on the blank.

BRIEF DESCRIPTION OF THE DRAWINGS

The above and optional objects, features, advantages and technical significance of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
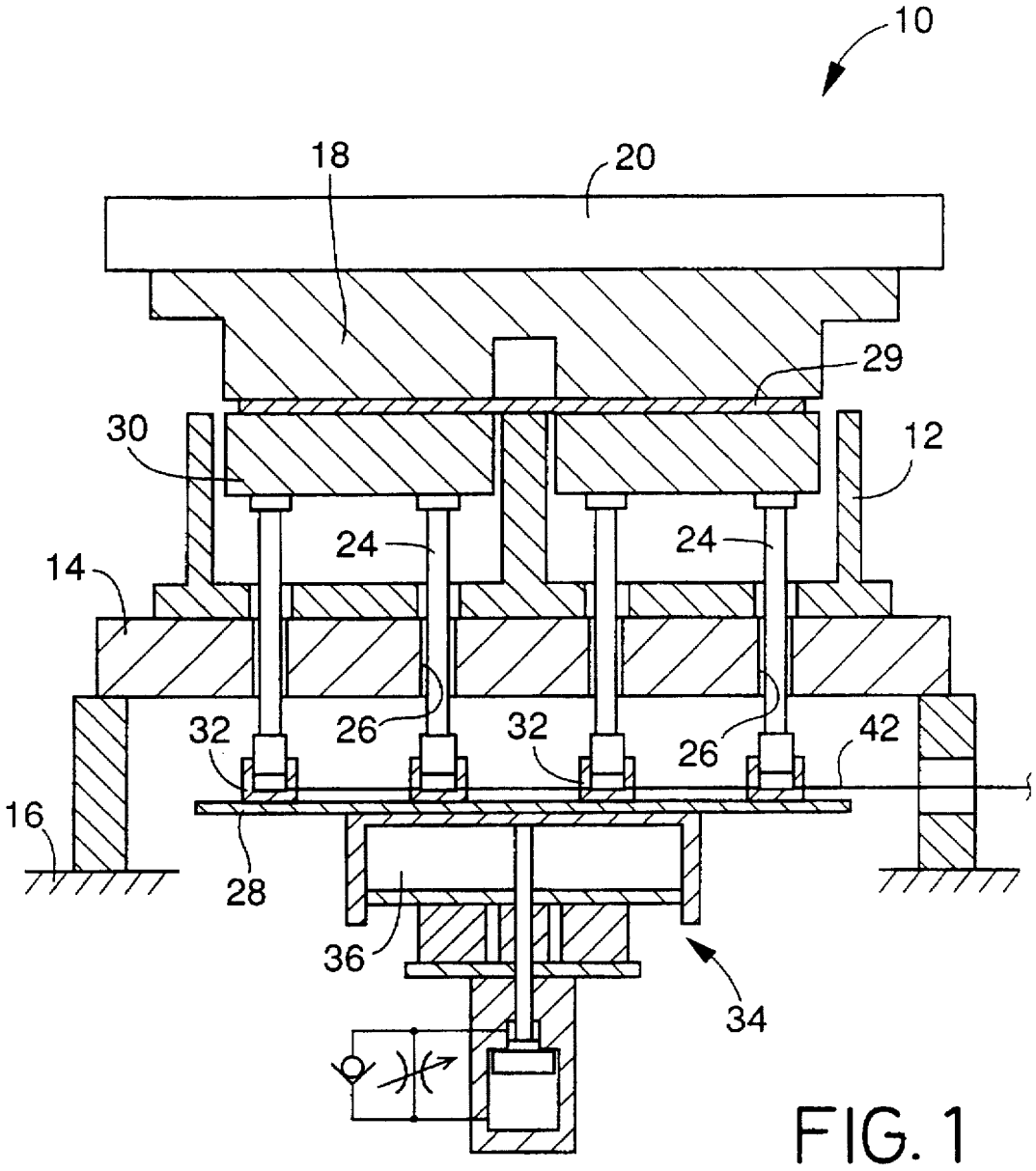
FIG. 1 is an elevational view in cross section showing a basic arrangement of a pressing machine that can be equipped with a balancing apparatus of this invention adapted to effect even distribution of a blank-holding force.

Referring first to FIG. 1, there is shown one example of a pressing machine 10 to which the present invention is applicable. In the pressing machine 10, a punch 12 is fixedly mounted on a bolster 14 which is fixed at a predetermined position on a machine bed 16, while an upper die 18 is attached to a slide plate 20 which is vertically reciprocable by suitable reciprocating means as well known in the art. The bolster 14 has a multiplicity of through-holes 26, and the punch 12 includes a base portion which has apertures aligned with the through-holes 26. As described below in detail, cushion pins 24 are disposed so as to extend these through-holes 26 and apertures.

Below the bolster 14, there is provided a cushion platen 28 for supporting the cushion pins 24, so that the cushion pins 24 support at their upper ends a pressure member in the form of a pressure ring 30 disposed adjacent to the punch 12. The number and locations of the cushion pins 24 are suitably determined depending upon the size, shape and other factors of the pressure ring 30. The punch 12 (lower die), upper die 18 and pressure ring 30 constitute a die set, which is removably installed on the machine 10 for performing a pressing operation on a blank 29. The pressure ring 30 cooperates with the upper die 18 to hold the blank 29 therebetween at a substantial portion of the blank 29 except its central portion, while the blank 29 is drawn by the punch 12 and die 18.

On the cushion platen 28, there are disposed a multiplicity of balancing hydraulic cylinders 32 corresponding to the through-holes 26. The hydraulic cylinders 32 have respective pistons 33(FIG.2), and respective piston rods connected to the pistons. The cushion pins 24 are supported at their lower ends by the piston rods of the respective hydraulic cylinders 32, such that the lower end faces of the cushion pins 24 are held in abutting contact with the upper end faces of the piston rods. The cushion platen 28 is vertically slidable while being guided by a suitable guide, and is biased in the upward direction by a cushioning pneumatic cylinder 34 which serves as force generating means for generating a blank-holding force during a pressing or drawing operation in which the pressure ring 30 is lowered by a downward movement of the slide plate 20.

Described more specifically, the slide plate 20 is reciprocated in each drawing cycle wherein the upper die 18 is brought into abutting contact with the blank 29 and is thereafter moved down with the pressure ring 30 during a downward stroke of the slide plate 20. As a result, the cushioning pneumatic cylinder 34 generates the blank-holding force which is determined by a pressure-receiving area of an air chamber 36 and an air pressure in the air chamber 36. The blank-holding force is transferred to the pressure ring 30 through the cushion platen 28, balancing hydraulic cylinders 32 and cushion pins 24. The volume of the pneumatic system including the air chamber 36 is constant, while the pressure in the air chamber 36 is adjustable depending upon the desired blank-holding force.

Figure 2:
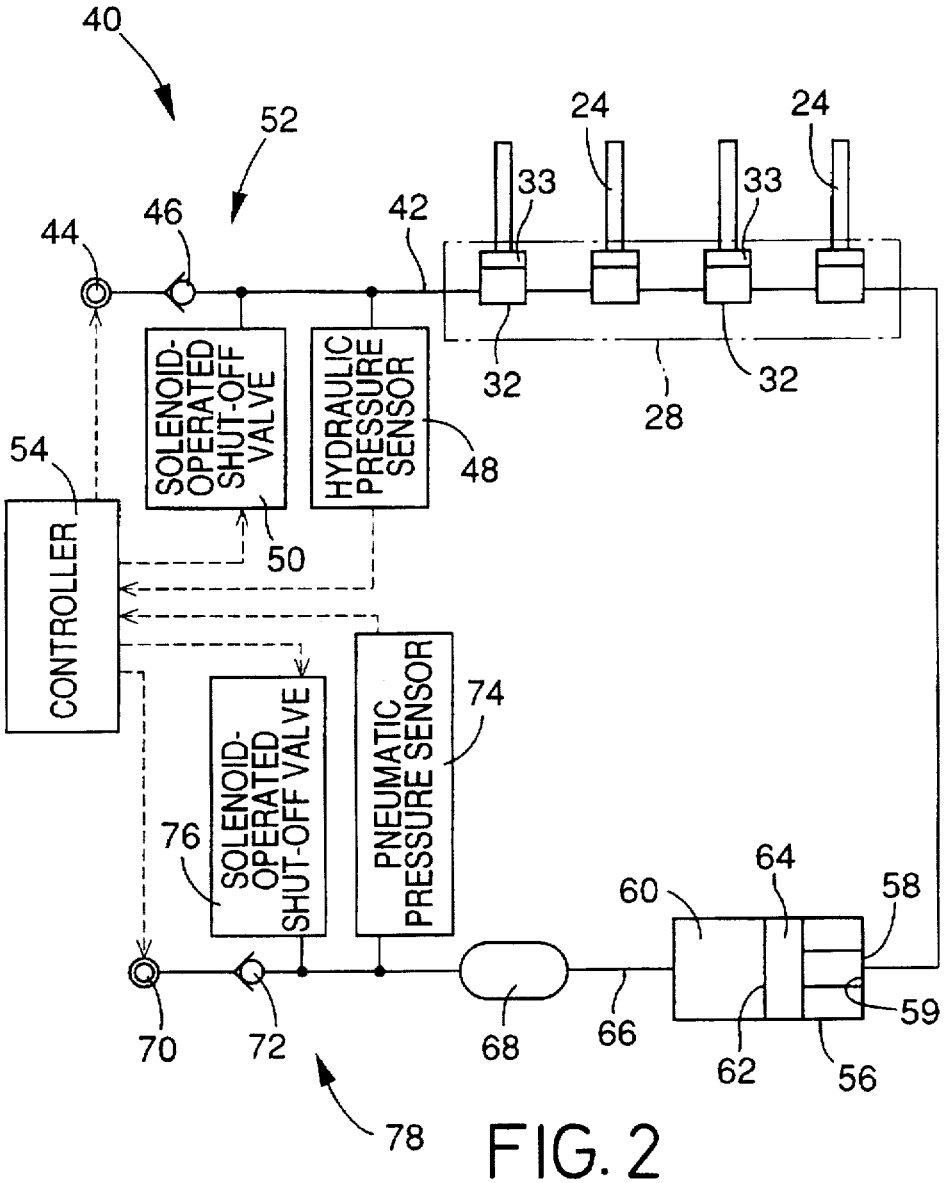
FIG. 2 is a view illustrating hydraulic and pneumatic circuits which provide one embodiment of the balancing apparatus as applied to the pressing machine of FIG. 1.

Referring next to FIG. 2, the multiple balancing hydraulic cylinders 32 constitute a portion of a balancing apparatus indicated generally at 40, which is constructed to assure even distribution of the blank-holding force over the entire area of the pressure ring 30 through the cushion pins 24. The hydraulic cylinders 32 have respective oil chambers which communicate with each other through a connecting passage 42. With the pressure in the oil chambers being suitable adjusted, the pistons 33 of all the hydraulic cylinders 35 used for a certain drawing operation, that is, the pistons 33 of all the hydraulic cylinders 32 which support all the cushion pins 24 installed are held at their neutral positions between the upper and lower stroke ends, so that the blank-holding force is evenly distributed to the pressure ring 30 and the blank 29 through the hydraulic cylinders 32 and all of the cushion pins 24.

The connecting passage 42 is connected to a hydraulic pressure source 44 such as a pump through a check valve 46, so that a pressurized working fluid is supplied to the oil chambers of the hydraulic cylinders 32. The connecting passage 42 is also connected to a hydraulic pressure sensor 48 and a solenoid-operated shut-off valve 50, so that the initial hydraulic pressure in the connecting passage 42 and hydraulic cylinders 32 prior to a pressing operation on the blank 29 is suitably adjusted with the solenoid-operated shut-off valve 50 being suitably opened and closed so as to control the amount of the pressurized fluid to be drained into a reservoir while the hydraulic pressure is monitored by the pressure sensor 48. The hydraulic pressure source 44 and solenoid-operated shut-off valve 50 constitute a major portion of hydraulic pressure regulating means 52, and are controlled by a controller 54 which is principally constituted by a microcomputer. The controller 54 receives an output signal of the hydraulic pressure sensor 48.

To the connecting passage 42, there is also connected discharge control means in the form of a hydro-pneumatic cylinder 56. The cylinder 56 has a piston 64 which has a relatively small first pressure-receiving surface 58 and a relatively large second pressure-receiving surface 62, which face in the opposite directions. The first pressure-receiving surface 58 partially defines an oil chamber 59 and receives the hydraulic pressure in the connecting passage 42. The second pressure-receiving surface 62 partially defines an air chamber 60. When the initial hydraulic pressure in the hydraulic cylinders 32 is adjusted prior to a pressing operation on the blank 29, a pneumatic pressure is applied to the air chamber 60 to hold the piston 64 in its original position, namely, the rightmost or fully advanced position as shown in FIG. 2. When the pressing operation is performed, the blank-holding force generated by the cushioning pneumatic cylinder 34 acts on the balancing hydraulic cylinders 32, and the hydraulic pressure in the hydraulic cylinders 32 is raised. As a result, the piston 64 is retracted by the hydraulic pressure in the oil chamber 59, from the fully advanced position against the pneumatic pressure in the air chamber 60, to a position of equilibrium between a force based on the hydraulic pressure acting on the first pressure-receiving surface 58 and a force based on the pneumatic pressure which acts on the second pressure-receiving surface 62 and which has been increased due to a decrease in the volume of the air chamber 60 as a result of a leftward retracting movement of the piston 64. Consequently, the working fluid is fed into the oil chamber 59 of the hydro-pneumatic cylinder 56 by an amount corresponding to the distance of the retracting movement of the piston 64. The initial pneumatic pressure in the air chamber 60 is adjusted so as to permit the piston 64 to be retracted by a suitable distance corresponding to the desired amount of the fluid to be fed into the oil chamber 59, so that the pistons 33 of all the hydraulic cylinders 32 involved in the pressing operation are placed in the neutral positions.

The air chamber 60 of the hydro-pneumatic cylinder 56 as the discharge control means is connected to an air tank 68 through a conduit 66. The air tank 68 is connected through the conduit 66 to a pneumatic pressure source 70 such as a pump through a check valve 72, so that compressed air is supplied to the air tank 68. The conduit 66 is also connected to a pneumatic pressure sensor 74 and a solenoid-operated shut-off valve 76, so that the initial pneumatic pressure in the air tank 68 and air chamber 60 prior to a pressing operation on the blank 29 is suitably adjusted with the solenoid-operated shut-off valve 76 being suitably opened and closed so as to control the amount of the compressed air to be drained while the pneumatic pressure is monitored by the pressure sensor 74. The pneumatic pressure source 70 and solenoid-operated shut-off valve 76 constitute a major portion of biasing force adjusting means 78 for adjusting the pneumatic pressure in the air chamber 60, that is, a biasing force based on the pressure in the air chamber 60, which biasing force acts on the piston 64. The pressure in the air chamber 60 may be considered as elastic means for producing a biasing force for biasing the piston 64 toward the original position. The pressure source 70 and shut-off valve 76 are controlled by the controller 54, which receives an output signal of the pneumatic pressure sensor 74.

There will be described the pneumatic pressure in the air chamber 60 of the hydro-pneumatic cylinder 56, which pressure permits the pistons 33 of the balancing hydraulic cylinders 32 to be placed in their neutral positions between the upper and lower stroke ends. In the balancing apparatus 40, the following equations (2) through (5) are satisfied:

$$Pvs \cdot Vv = Pvx(Vv - Ava \cdot Sr) \quad (2)$$

$$Pvx \cdot Ava = Psx \cdot Avs \quad (3)$$

$$Aa \cdot Pax - Wp = n \cdot As \cdot Psx \quad (4)$$

$$Pas \cdot Va = Pax(Va - Aa \cdot St) \quad (5)$$

where,

Aa: Pressure-receiving area of the pneumatic cylinder 34;

pas: Initial pneumatic pressure in the air chamber 36 of the pneumatic cylinder 34;

Pax: Pneumatic pressure in the air chamber 36 at lower stroke end of the cushion platen 28;

St: Operating stroke of the cushion platen 28 to the lower stroke end;

Va: Initial volume of the pneumatic system including the air chamber 36;

Wp: Weight of the cushion platen 28;

n: Number of the cushion pins 24 used;

As: Pressure-receiving area of each hydraulic cylinder 32;

Pss: Initial hydraulic pressure in the hydraulic cylinders 32;

Psx: Hydraulic pressure in the hydraulic cylinders 32 at the lower stroke end of the cushion platen 28;

Xav: Optimum average operating stroke of the pistons 33 of the hydraulic cylinders 32 to the neutral positions;

Avs: Area of the first pressure-receiving surface 58 of the hydro-pneumatic cylinder 56;

Ava: Area of the second pressure-receiving surface 62 of the cylinder 56;

Pvs: Initial pneumatic pressure in the air chamber 60;

Pvx: Pneumatic pressure in the air chamber 60 at the lower stroke end of the cushion platen 28;

Vv: initial volume of the pneumatic system including the air chamber 60;

Sr: Retracting stroke of the piston 64 corresponding to the lower stroke end of the slide plate 20 (cushion platen 28).

The above equation (2) relates to a change in the pneumatic pressure in the air chamber 60 of the hydro-pneumatic cylinder 56. The above equation (3) relates to the position of equilibrium of the piston 64 of the hydro-pneumatic cylinder 56 at the lower stroke end of the slide plate 20 (cushion platen 28). The above equation (4) relates to the position of balance between the cushioning pneumatic cylinder 34 and the balancing hydraulic cylinders 32. The above equation (5) relates to a change in the pneumatic pressure in the air chamber 36 of the pneumatic cylinder 34.

The following equation (6) is obtained from the above equations (2) through (5), and the following equation (7) is obtained since the amount of discharge flow of the working fluid from the hydraulic cylinders 32 through the connecting passage 42 is equal to the amount of the fluid into the oil chamber 59 of the hydro-pneumatic cylinder 56, if it is assumed that the working fluid in the hydraulic cylinders 32 is non-compressible when the initial hydraulic pressure Pss is as high as about $80 \times 9.8 \times 10^4$ Pa. The following equation (8) is obtained from these equations (6) and (7).

$$Sr = \frac{Vv}{Ava}\left[1 - \frac{n \cdot As \cdot Ava \cdot Pvs}{Avs\left(\frac{Aa \cdot Va \cdot Pas}{Va - Aa \cdot St} - Wp\right)}\right] \quad (6)$$

$$n \cdot As \cdot Xav = Avs \cdot Sr \quad (7)$$

$$Xav = \frac{Avs \cdot Vv}{n \cdot As \cdot Ava}\left[1 - \frac{n \cdot As \cdot Ava \cdot Pvs}{Avs\left(\frac{Aa \cdot Va \cdot Pas}{Va - Aa \cdot St} - Wp\right)}\right] \quad (8)$$

In the above equation (8), the pressure-receiving areas Ava, Avs, Aa and As, volumes Vv and Va, weight Wp and optimum average operating stroke Xav are determined by the specifications of the pressing machine 10, while the number n of the cushion pins 24, operating stroke St of the cushion platen 28 and initial pneumatic pressure Pas are determined by the predetermined pressing conditions such as the desired or optimum blank-holding force. That is, those parameters Ava, Avs, Aa, As, Vv, Va, Wp, Xav, n, St and Pas are known. Therefore, the initial pneumatic pressure Pvs in the air chamber 60 of the hydro-pneumatic cylinder 56 can be calculated according to the above equation (8). The initial hydraulic pressure Pss in the hydraulic cylinders 32 is determined so as to satisfy the inequality Pvs·Ava>Pss·Avs, so that the piston 64 of the hydro-pneumatic cylinder 56 is held at the original position (fully advanced or rightmost position of FIG. 2) prior to a pressing operation on the machine 10.

Thus, the balancing apparatus 40 is adapted so that the working fluid is fed into the hydro-pneumatic cylinder 56 through the connecting passage 42 during a pressing or drawing operation on the blank 29, so as to permit the pistons 33 of the balancing hydraulic cylinders 32 to be placed in the neutral positions. Therefore, the initial hydraulic pressure Pss in the hydraulic cylinders 32 can be adjusted to a level within a range that satisfies the inequality Pvs·Ava>Pss·Avs·For example, the initial hydraulic pressure Pss can be adjusted to a level in the neighborhood of $80 \times 9.8 \times 10^4$ Pa at which the working fluid is substantially non-compressible irrespective of the temperature of the fluid and the amount of air mixed therein. If the initial hydraulic pressure Pss is adjusted to such level, the pistons 33 of all the hydraulic cylinders 32 used for a pressing operation on the blank 29 are placed in their neutral positions which permit even distribution of the blank-holding force, irrespective of the varying temperature of the working fluid and the amount of air in the fluid. Conventionally, the pistons 33 of the hydraulic cylinders 32 are placed in the neutral positions utilizing the compression of the working fluid owing to the presence of air in the fluid. Therefore, the conventional balancing apparatus requires the initial hydraulic pressure Pss to be relatively low so that the working fluid has a relatively low modulus of elasticity of volume and is compressible in the presence of air mixed therein. This conventional arrangement suffers from a variation in the compressibility of the fluid due to varying amount of air mixed with the oil, which may cause a risk that some of the pistons 33 of the hydraulic cylinders 32 remain in the upper stroke end or move down to the lower stroke end, leading to uneven distribution of the blank-holding force. To the contrary, the present balancing apparatus 40 using the hydro-pneumatic cylinder 56 is adapted to establish the neutral positions of the pistons 33 of the hydraulic cylinders 32 by a discharge flow of the working fluid into the hydro-pneumatic cylinder 56. The present balancing apparatus 40 does not rely on the compressibility of the working fluid, that is, permits the initial hydraulic pressure Pss to be set at a high level at which the fluid is not compressible or the compressibility of the fluid is substantially constant regardless of the fluid temperature and the amount of air in the fluid. Thus, the present balancing apparatus 40 assures even distribution of the blank-holding force without an influence of the varying fluid temperature and the amount of air mixed in the fluid.

In the present embodiment of FIG. 2, the hydro-pneumatic cylinder 56 which is used as the discharge control means is adapted such that during a pressing operation on the pressing machine 10 the piston 64 is retracted by the hydraulic pressure in the oil chamber 59, against the pneumatic pressure in the air chamber 60, to the position of equilibrium that satisfies the above equation (3), so that the oil chamber 59 receives the amount of the oil corresponding to the retracting movement of the piston 64, to enable the pistons 33 of the hydraulic cylinders 32 to be moved to the neutral positions. This arrangement is advantageous over an arrangement in which the initial pneumatic pressure Pvs in the air chamber 60 is set at a level lower than that calculated according to the above equation (8), and the piston 64 is stopped by a suitable stop at a predetermined position, more specifically, when the retracting stroke Sr of the piston 64 according to the above equation (7) is reached. The present arrangement assures reduced tendency of abrupt change or reduced amount of pulsation of the hydraulic pressure in the hydraulic cylinders 32, and effectively prevents deterioration of quality of the products produced by pressing, which would arise from an undesirable change in the blank-holding force due to the change in the pressure in the hydraulic cylinders The present balancing apparatus 40 does not use a device for reciprocating the piston 64. Namely, the piston 64 of the hydro-pneumatic cylinder 56 is moved by the force based on the hydraulic pressure in the connecting passage 42 (oil chamber 59), to the position of equilibrium between the above-indicated force and the force based on the pneumatic pressure in the oil chamber 60, whereby the working fluid is automatically discharged from the hydraulic cylinders 32 through the connecting passage 42 into the oil chamber 59. Accordingly, the balancing apparatus 40 including the controller 54 as well as the hydro-pneumatic cylinder 56 is simpler in construction and more economical to manufacture, than the apparatus provided with a device for positively controlling the position of the piston 64. Further, the present balancing apparatus 40 using the hydro-pneumatic cylinder 56 which utilizes air pressure can be readily adapted to specific configurations of the pressing machine 10 which are operated under different pressing conditions. All what is required for adaptation of the balancing apparatus 40 is an adjustment of the initial pneumatic pressure Pvs in the air chamber 60. Thus, the balancing apparatus 40 has a high degree of versatility.

Other embodiments of the present invention will be described by reference to FIGS. 3–7, wherein the same reference numerals as used in the first embodiments of FIGS. 1 and 2 are used to identify the functionally corresponding elements, which will not be described to avoid redundant explanation.

Figure 3A:
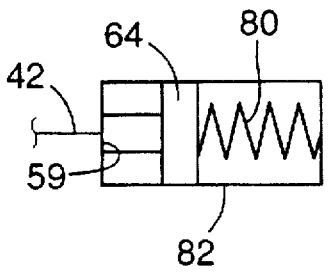
FIG. 3(*a*) and 3(*b*) are views showing discharge control means used in other embodiments of the invention in place of discharge control means used in the embodiment of FIG. 2.
Figure 3B:
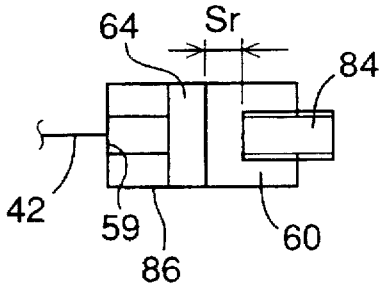

A second embodiment of FIG. 3(*a*) uses discharge control means in the form of a discharge control cylinder 82 which has a spring 80 as elastic means for producing a biasing force for biasing the piston 64 toward the original or fully advanced position. In the discharge control cylinder 82, the following equation (9) is satisfied, and the following equation (10) is obtained from this equation (9) and the above equations (4) and (5). Further, the following equation (11) is obtained from this equation and the above equation (7).

$$Avs \cdot Psx = k(Sr + lo) \tag{9}$$

$$Sr = \frac{Avs}{n \cdot As \cdot k}\left(\frac{Aa \cdot Va \cdot Pas}{Va - Aa \cdot St} - Wp\right) - lo \tag{10}$$

$$Xav = \frac{Avs}{n \cdot As}\left[\frac{Avs}{n \cdot As \cdot k}\left(\frac{Aa \cdot Va \cdot Pas}{Va - Aa \cdot St} - Wp\right) - lo\right] \tag{11}$$

where, k: Constant of the spring 80; and lo: initial amount of compressive deformation of the spring 80.

The above equation (9) relates to a balance between the biasing force of the spring 80 at the lower stroke end of the slide plate 20 (cushion platen 28) and a force based on the hydraulic pressure in the oil chamber 59. The same effect and advantages as provided in the first embodiment are provided in the present second embodiment, by determining the constant k and initial amount of compressible deformation 10 of the spring 80 so as to satisfy the above equation (11). In the present second embodiment, the initial hydraulic pressure Pss in the hydraulic cylinders 32 can be suitably set within a range that satisfies the inequality Avs·Pss<k·lo.

Referring next to FIG. 3(*b*), there is illustrated discharge control means in the form of a discharge control cylinder 86 according to a third embodiment of this invention, wherein a stopper screw 84 is provided to define the fully retracted position of the piston 64. The stopper screw 84 is positioned so as to establish the retracting stroke Sr of the piston 64 as calculated according to the above equation (7). To hold the piston 64 at the original or fully advanced position upon adjustment of the initial hydraulic pressure Pss, it is desirable either to charge the air chamber 60 with a compressed gas (as an elastic medium or means) whose pressure is equal to or slightly lower than the initial pneumatic pressure Pvs as calculated according to the above equation (8), or to dispose a spring or other suitable elastic member or means within the air chamber 60. However, it is possible to first position the piston 64 at its original position by advancing the stopper screw 84 into abutting contact with the piston 64 at the original position, then adjust the initial hydraulic pressure Pss in this condition, and finally retract the stopper screw 84 by a distance equal to the retracting stroke Sr as calculated according to the above equation (7).

Figure 4:
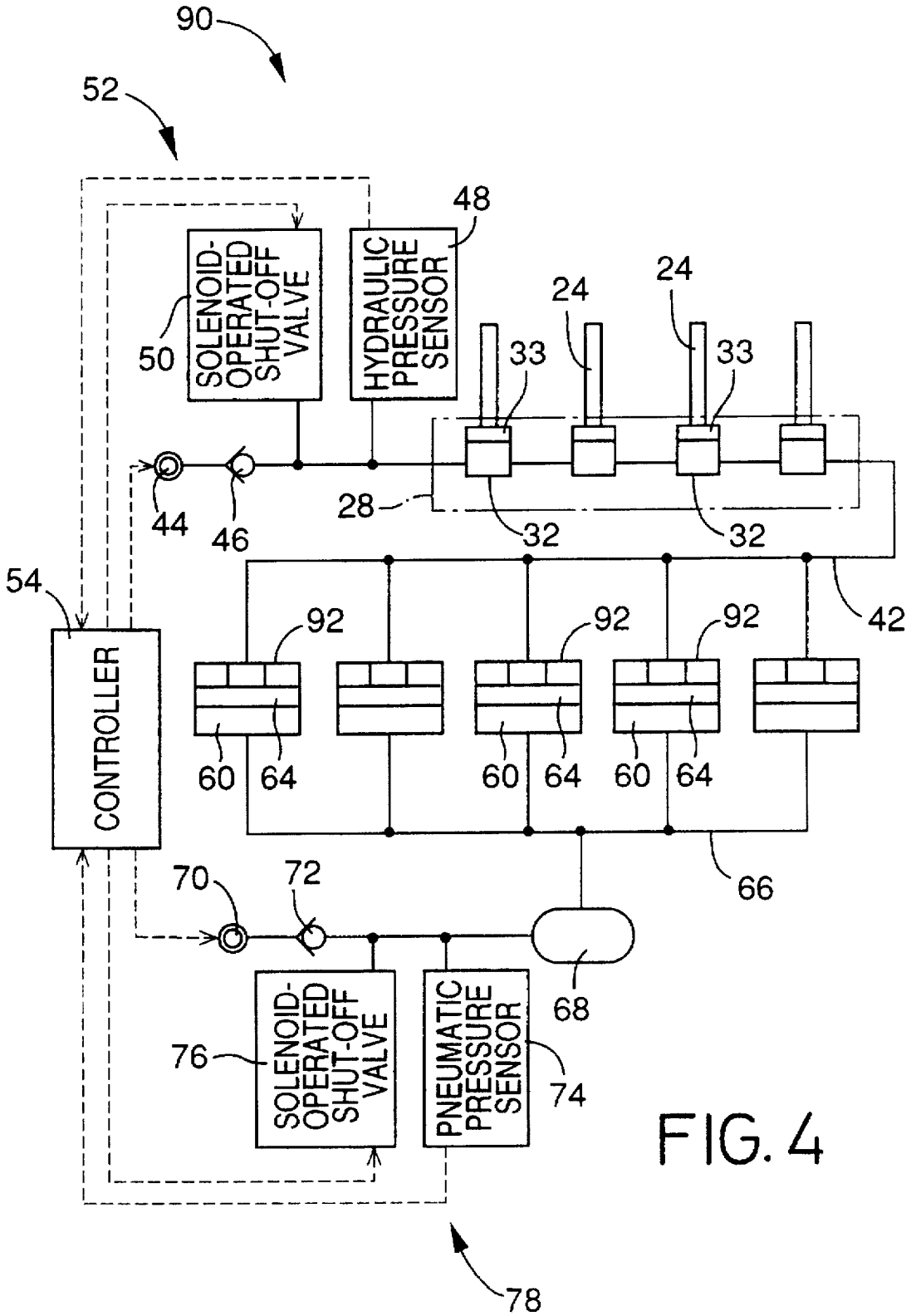
FIG. 4 is a view corresponding to that of FIG. 2, showing a further embodiment of the invention.

Referring to FIG. 4, there is illustrated a balancing apparatus 90 according to a fourth embodiment of the present invention, which is different from the balancing apparatus 40 of the first embodiment, in that a plurality of hydro-pneumatic cylinders 92 in parallel connection with each other are used as discharge control cylinders which constitute the discharge control means. Each hydro-pneumatic cylinder 92 is similar to the hydro-pneumatic cylinder 56 having the piston 64 and the air chamber 60. Where the number of the hydro-pneumatic cylinders 92 is equal to "m", and all of the cylinders 92 have the same dimensions, the following equation (12) corresponding to the above equation (2) is obtained in this case, and the retracting stroke Sr of the piston 64 of each hydro-pneumatic cylinder 92 is represented by the following equation (13).

$$Pvs \cdot Vv = Pvx(Vv - m \cdot Ava \cdot Sr) \tag{12}$$

$$Sr = \frac{Vv}{m \cdot Ava}\left[1 - \frac{n \cdot As \cdot Ava \cdot Pvs}{Avs\left(\frac{Aa \cdot Va \cdot Pas}{Va \cdot Aa \cdot St} - Wp\right)}\right] \tag{13}$$

It will be understood that the retracting stroke Sr of the piston 64 of each hydro-pneumatic cylinder 92 is 1/m of the stroke Sr of the piston 64 of the hydro-pneumatic cylinder 56. It is noted that the optimum average operating stroke Xav of the pistons 33 of the hydraulic cylinders 32 is represented by the above equation (8). Thus, the present balancing apparatus 90 is identical with the balancing apparatus 40 of the first embodiment, except for the multiple hydro-pneumatic cylinders 92 and the retracting stroke Sr of their pistons 64.

In the balancing apparatus 90 of the fourth embodiment, the retracting stroke Sr of the piston 64 of each hydro-pneumatic cylinder 92 decreases with an increase in the number m of the cylinders 92. Accordingly, the axial dimension of the hydro-pneumatic cylinders 92 can be reduced as compared with that of the single hydro-pneumatic cylinder 56 used in the first embodiment of FIG. 2. If the cylinders 92 are arranged in the horizontal plane as in the present example of FIG. 4, the cylinders 92 can be installed in a relatively small space having a relatively small height dimension. Thus, the cylinders 92 have a relatively high degree of freedom of layout or arrangement. In this respect, it is desirable that the pressure-receiving area Avs of the pistons 64 of the cylinders 92 which receives the hydraulic pressure in the connecting passage 42 be relatively small in order to reduce the pneumatic pressure required to hold the pistons 64 at the original positions. At the same time, it is also desirable to increase the retracting stroke Sr of the pistons 64 in order to increase the amount of the fluid that can be received by the hydro-pneumatic cylinders 92. In the case the balancing apparatus uses a single hydro-pneumatic cylinder as in the first embodiment of FIG. 2, the required retracting stroke of the piston of that single cylinder should be relatively large. In the present balancing apparatus 90 using the two or more hydro-pneumatic cylinders 92 disposed in parallel connection with each other, the required retracting stroke Sr of the piston 64 of each cylinder 92 can be made relatively small, whereby the axial dimension of each cylinder 92 can be reduced. Although the required piston stroke Sr can be reduced by increasing the pressure-receiving area Avs which receives the hydraulic pressure, the increased pressure-receiving area Avs results in an increased load which acts on the piston and the cylinder housing. Therefore, there is a limitation in increasing the pressure-receiving area Avs from the standpoint of the mechanical strength of the hydro-pneumatic cylinder.

In the present balancing apparatus 90, the air chambers 60 of the hydro-pneumatic cylinders 92 are connected to each other through the conduit 66, and the initial pneumatic pressure Pvs can be easily and efficiently adjusted as in the first embodiment.

Figure 5:
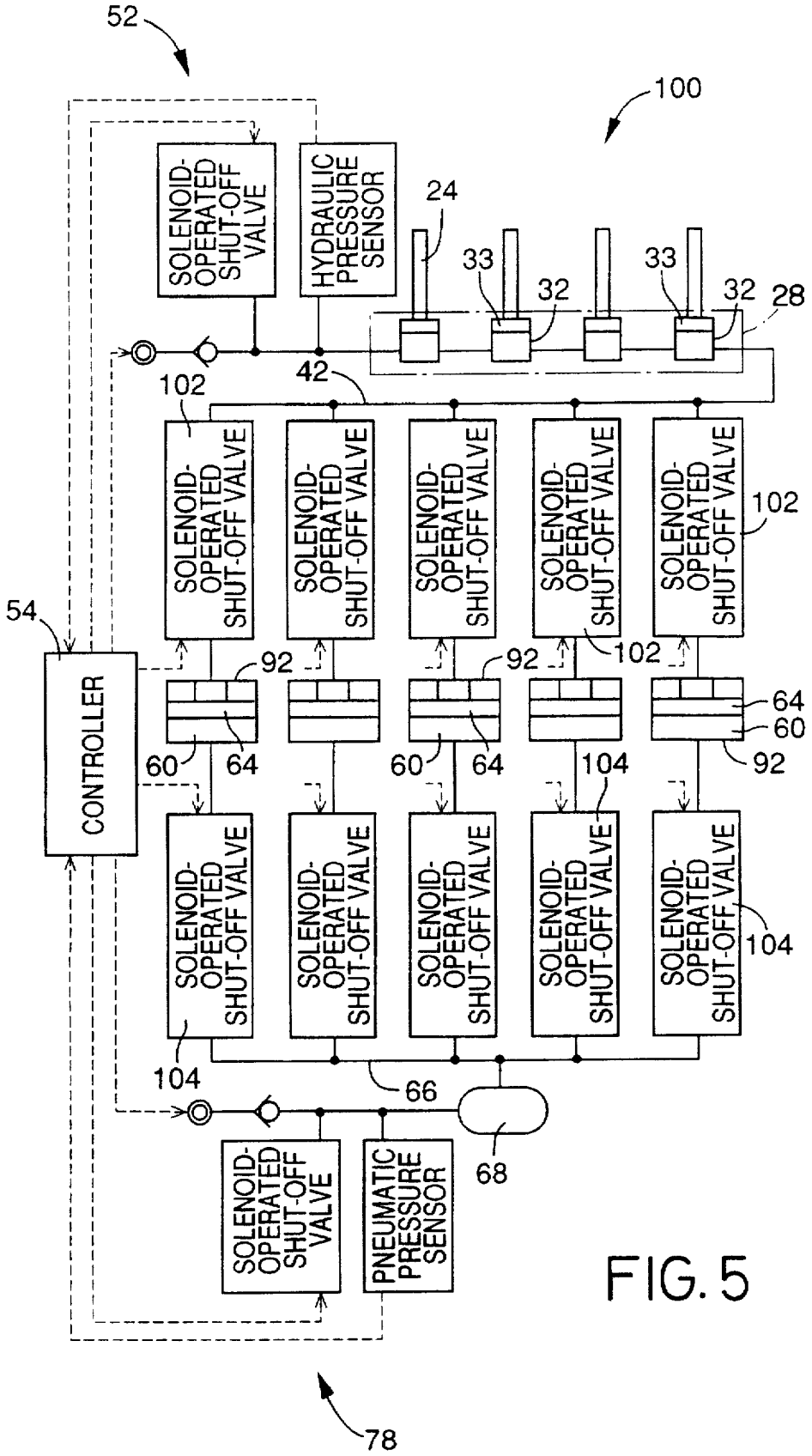
FIG. 5 is a view corresponding to that of FIG. 2, showing a still further embodiment of the invention.

In a balancing apparatus 100 shown in FIG. 5 constructed to a fifth embodiment of this invention, each of the hydro-pneumatic cylinders 92 as the discharge control cylinders is connected to the connecting passage 42 through a solenoid-operated shut-off valve 102, and to the conduit 66 through another solenoid-operated shut-off valve 104. These solenoid-operated shut-off valves 102, 104 for the individual cylinders 92 are controlled by the controller 54, independently of each other. By controlling the solenoid-operated shut-off valves 104 on the side of the conduit 66 independently of each other, the initial pneumatic pressures Pvs in the individual cylinders 95 can be controlled to different values independently of each other. Further, since the solenoid-operated shut-off valves 105 on the side of the connecting passage 42 can be selectively opened or closed independently of each other, the number of the hydro-pneumatic cylinders 92 that are actually used for a certain pressing operation on the blank 29 can be selected or determined as needed, depending upon the specific pressing condition, so as to establish even distribution of the blank-holding force irrespective of the varying pressing condition. It will be understood that the solenoid-operated shut-off valves 102 functions as means for selecting the hydro-pneumatic cylinders 92 that are actually used, namely, means for selectively enabling the cylinders 92 to be operative.

There will be described an operation of the balancing apparatus 100 in the case where only two hydro-pneumatic cylinders 95 are provided. These two cylinders 92 are referred to as a first and a second hydro-pneumatic cylinder whose initial pneumatic pressures are represented by Pvs1 and Pvs2, respectively, and whose piston retracting strokes are represented by Sr1 and Sr2, respectively. If only the first hydro-pneumatic cylinder 92 is enabled to be operative for a pressing operation on the blank 29, the piston retracting stroke Sr1 and the optimum average operating stroke Xav of the hydraulic cylinders 32 are represented by the following equations (14) and (15), respectively. If only the second hydro-pneumatic cylinder 92 is enabled, the piston retracting stroke Sr2 and the optimum average operating stroke Xav are represented by the following equations (16) and (17). If the first and second hydro-pneumatic cylinders 92 are both enabled to be operative, the piston retracting strokes Sr1 and Sr2 and the optimum average operating stroke Xav are represented by the following equations (18), (19) and (20), respectively.

$$Sr1 = \frac{Vv}{Ava}\left[1 - \frac{n \cdot As \cdot Ava \cdot Pvs1}{Avs\left(\frac{Aa \cdot Va \cdot Pas}{Va - Aa \cdot St} - Wp\right)}\right] \tag{14}$$

$$Xav = \frac{Avs \cdot Vv}{n \cdot As \cdot Ava}\left[1 - \frac{n \cdot As \cdot Ava \cdot Pvs1}{Avs\left(\frac{Aa \cdot Va \cdot Pas}{Va - Aa \cdot St} - Wp\right)}\right] \tag{15}$$

$$Sr2 = \frac{Vv}{Ava}\left[1 - \frac{n \cdot As \cdot Ava \cdot Pvs2}{Avs\left(\frac{Aa \cdot Va \cdot Pas}{Va - Aa \cdot St} - Wp\right)}\right] \tag{16}$$

$$Xav = \frac{Ava \cdot Vv}{n \cdot As \cdot Ava}\left[1 - \frac{n \cdot As \cdot Ava \cdot Pvs2}{Avs\left(\frac{Aa \cdot Va \cdot Pas}{Va - Aa \cdot St} - Wp\right)}\right] \tag{17}$$

$$Sr1 = \frac{Vv}{Ava}\left[1 - \frac{n \cdot As \cdot Ava \cdot Pvs1}{Avs\left(\frac{Aa \cdot Va \cdot Pas}{Va - Aa \cdot St} - Wp\right)}\right] \tag{18}$$

$$Sr2 = \frac{Vv}{Ava}\left[1 - \frac{n \cdot As \cdot Ava \cdot Pvs2}{Ava\left(\frac{Aa \cdot Va \cdot Pas}{Va - Aa \cdot St} - Wp\right)}\right] \tag{19}$$

-continued $$Xav = \frac{Avs \cdot Vv}{n \cdot As \cdot Ava}\left[2 - \frac{n \cdot As \cdot Ava \cdot (Pvs1 + Pvs2)}{Avs\left(\frac{Aa \cdot Va \cdot Pas}{Va - Aa \cdot St} - Wp\right)}\right] \quad (20)$$

The initial volume of the pneumatic system is a sum of the total volume of the air chamber(s) 60 of the first and/or second hydro-pneumatic cylinder(s) 92 and a total volume of a portion(s) of the conduit 66 between the air chamber(s) 60 and the shut-off valve(s) 104. The air tank 68 is not essential, and an air tank of a suitable volume may be provided between the air chambers 60 of the cylinders 92 and the shut-off valves 104.

If the initial pneumatic pressures Pvs1, Pvs2 of the first and second hydro-pneumatic cylinders 92 are adjusted to different values by the respective solenoid-operated shut-off valves 104, the optimum average operating stroke Xav of the hydraulic cylinders 32 can be set at one of the three different values as represented by the above equations (15), (17) and (20), depending upon which one of the first and second cylinders 92 is enabled, and whether both of the first and second cylinders 92 are enabled. In the present arrangement, therefore, the balancing apparatus 100 is capable of dealing with three different pressing conditions (combinations of various operating parameters such as the number n of the cushion pins 24 and the initial pneumatic pressure Pas in the air cylinder 34 which determines the blank-holding force), which correspond to three different products to be manufactured. For instance, a pressing operation to manufacture the first product is performed by enabling only the first hydro-pneumatic cylinder 92, while a pressing operation to manufacture the second product is performed by enabling only the second hydro-pneumatic cylinder 92, and a pressing operation to manufacture the third product is performed by using both of the first and second hydro-pneumatic cylinders 92. The initial pneumatic pressure values Pvs1, Pvs2 are suitably adjusted to establish the optimum average operating stroke Xav of the hydraulic cylinders 32 in each of the three pressing operations under the different conditions. One or both of the first and second hydro-pneumatic cylinders 92 is/are enabled to be operative by opening the corresponding shut-off valve or valves 102, depending upon the product to be manufactured.

In the balancing apparatus 100, the initial pneumatic pressures Pvs of the selected ones of the plurality of hydro-pneumatic cylinders 92 are adjusted to respective values, and the number of the hydro-pneumatic cylinders 92 actually used for a given pressing operation on the blank 29 is determined depending upon the number n of the cushion pins 24 and other operating parameters established for that pressing operation. The cylinders 92 are selectively used or enabled to be operative by opening the respective solenoid-operated shut-off valves 102, so as to establish the optimum relationship between the amount of discharge flow of the fluid from the hydraulic cylinders 32 through the connecting passage 42 and the change in the pressure in the hydraulic cylinders 32, for assuring even distribution of the blank-holding force under different pressing conditions used for different products. For instance, the shut-off valves 102 are controlled so as to hold the pistons 33 of the hydraulic cylinders 32 at the neutral positions during pressing operations while the amount of discharge flow of the fluid from the hydraulic cylinders 32 is kept substantially constant irrespective of a change of the blank-holding force, that is, irrespective of a change in the hydraulic pressure Psx at the lower stroke end of the slide plate 20. Alternatively, the shut-off valves 102 are controlled so as to maintain the hydraulic pressure Psx which assures the optimum blank-holding force irrespective of a change in the amount of discharge flow of the fluid required to place the pistons 33 of the hydraulic cylinders 32 at the neutral positions, which change occurs due to a change in the number of the hydraulic cylinders 32 used, that is, a change in the number n of the cushion pins 24 installed.

Figure 6:
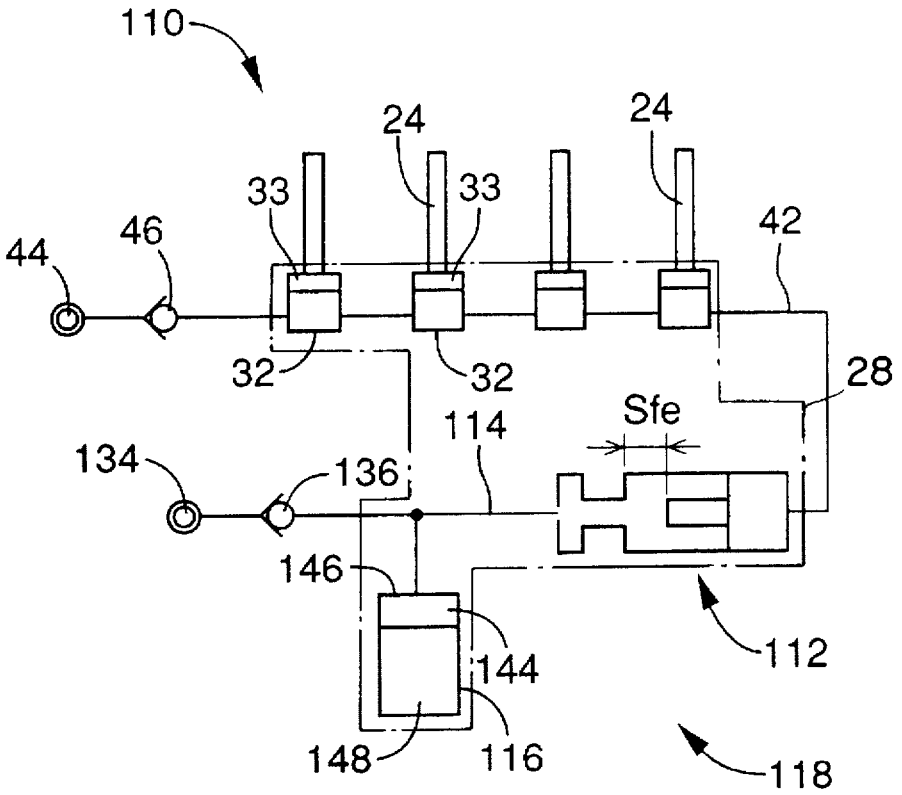
FIG. 6 is a view illustrating a hydraulic circuit used in a yet further embodiment of the invention.

Referring next to FIG. 6, there is illustrated a balancing apparatus 110 constructed according to a sixth embodiment of this invention. In this balancing apparatus 110, a free-piston cylinder 112 as a discharge control cylinder device is connected to the connecting passage 42. This free-piston cylinder 112 is connected to a hydro-pneumatic cylinder 116 through a conduit 114. The free-piston cylinder 112 and the hydro-pneumatic cylinder 116 cooperate to constitute discharge control means 118. These cylinders 112, 116 are disposed on the cushion platen 28, together with the multiple hydraulic cylinders 32, as indicated by the one dot chain line block of FIG. 6. In this arrangement wherein the connecting passage 42 is relatively short, the initial volume of the fluid in the hydraulic cylinders 32 and connecting passage 42 is relatively small so that a relatively large amount of change of the hydraulic pressure is obtained by a relatively small amount of change of the volume of the fluid. Described more specifically, an amount of change ΔPs of the hydraulic pressure Ps in the cylinders 32 and passage 42 is represented by the following equation (21):

$$\Delta Ps = K \cdot Vs / Vs \quad (21)$$

where,

Vs: Initial volume of the fluid;

ΔVs: Amount of change of the initial volume Vs;

ΔPs: Amount of change of the hydraulic pressure Ps; and

K: Modulus of elasticity of volume of the fluid.

The amount of change ΔPs of the hydraulic pressure Ps corresponding to a given amount of change ΔVs of the volume of the working fluid increases with a decrease in the initial volume Vs of the fluid. Since the present arrangement permits a relatively large amount of change ΔPs of the hydraulic pressure Ps with a relatively small amount of change ΔVs of the fluid volume, the hydraulic pressure Psx when the slide plate 20 is located at the lower stroke end can be adjusted to the optimum value by a relatively small amount of change ΔVs of the volume Vs, even if the compressibility or modulus K of elasticity of volume of the working fluid varies due to the varying temperature of the fluid and the varying amount of air mixed with the oil. In other words, the hydraulic pressure Psx is less likely to be influenced by the modulus K of elasticity of volume of the working fluid.

Figure 7:
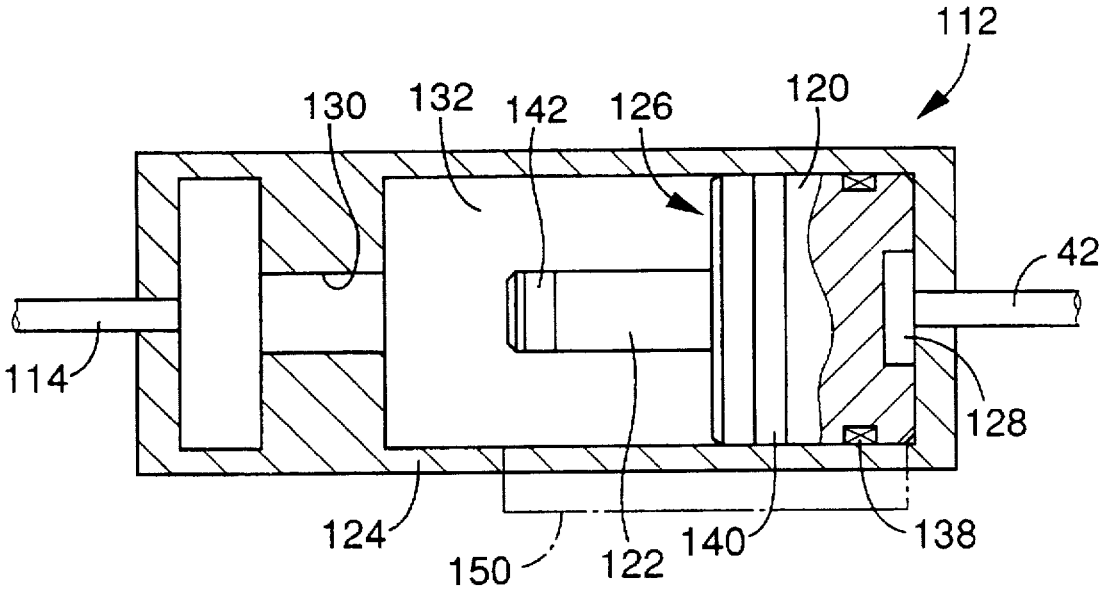
FIG. 7 is a cross sectional view showing in detail a free-piston cylinder.

The free-piston cylinder 112, which is shown in detail in FIG. 7, includes a stepped piston 126 which has a large-diameter portion 120 and a small-diameter portion 122 and which is slidably movable within a cylinder body 124. The cylinder 112 has a first chamber 128 which is defined by the cylinder body 124 and the large-diameter portion 120 and which communicates with the connecting passage 42, and a second chamber 132 which is defined by the cylinder body 124 and the small- and large-diameter portions 122, 120 and which is able to communicate with the above-indicated conduit 114 through a hole 130 formed through the cylinder body 124. When the stepped piston 126 is placed in its original position of FIG. 7 (stroke end on the side of the large-diameter portion 120), the second chamber 132 communicates with the conduit 114 through the hole 130, and a pressurized fluid delivered as a control fluid from a hydraulic pressure source 134 through a check valve 136 is permitted to flow between the second chamber 132 and the conduit 114. When the piston 126 is moved or retracted by more than a predetermined distance Sfe from the original position toward the second chamber 132, the hole 130 is closed at the end remote from the conduit 114 by the small-diameter portion 122, whereby the fluid communication between the second chamber 132 and the conduit 114 is inhibited. The stepped piston 126 is provided with sealing members 138, 140, and 142 for fluid tightness with respect to the cylinder body 124 and the hole 130. The distance Sfe indicated above is a retracting stroke of the stepped piston 126 from the original position, which is necessary to establish fluid-tight sealing between the hole 130 and the small-diameter portion 122 by the sealing member 142 and to fluid-tightly disconnect the second chamber 132 from the hole 130 for inhibiting the fluid from flowing from the second chamber 132 to the conduit 114. A by-pass passage 150 indicated by one-dot chain line in FIG. 7 connects the first and second chambers 128, 132 and has a function of an orifice. If this by-pass passage 150 is provided, it facilitates filling of the free-piston cylinder 112 with the working fluid.

The retracting stroke Sfe of the stepped piston 126 is determined so as to satisfy the following equation (22) which corresponds to the above equation (7).

$$n \cdot As \cdot Xav = Afe \cdot Sfe \quad (22)$$

where,

Afe: Pressure-receiving area of the large-diameter portion 120 of the piston 126.

Prior to a pressing operation on the machine 10, the pistons 33 of all of the used hydraulic cylinders 32 are placed at their upper stroke ends. An increase in the fluid pressure in the hydraulic cylinders 32 and connecting passage 42 during the pressing operation will cause the stepped piston 126 to be retracted from the original position by the determined retracting stroke Sfe, whereby the pistons 33 of the hydraulic cylinders 32 (corresponding to the cushion pins 24 installed) are moved down by the optimum average operating stroke Xav and are thereby placed in their neutral positions between the upper and lower stroke ends. Where the initial hydraulic pressure Pss in the hydraulic cylinders 32 and connecting passage 42 is set as high as in the preceding embodiments, the actual average operating stroke of the pistons 33 of the hydraulic cylinders 32 at the lower stroke end of the slide plate 20 can be maintained at the optimum value Xav. In the present embodiment wherein the initial volume Vs of the fluid in the connecting passage 42 is relatively small, a relatively small amount of change of the fluid volume will cause a relatively large amount of change of the hydraulic pressure Ps. Therefore, even if the initial hydraulic pressure Pss is set as low as the atmospheric pressure, the amount of change of the fluid volume required to obtain the hydraulic pressure Psx corresponding to the desired blank-holding force is considerably small. In other words, a relatively small amount of change of the fluid volume permits the pistons 33 of the hydraulic cylinders 32 to be moved down by the optimum average operating stroke Xav. Further, since the fluid volume of the closed second chamber 132 is also small, the stepped piston 126 remains at the retracted position corresponding to the determined retracting stroke Sfe, even if the hydraulic pressure in the connecting passage changed by a relatively large amount. In other words, a relatively large amount of change of the hydraulic pressure in the passage 42 will not cause a flow of the fluid from the passage 42 into the free-piston cylinder 112, which would undesirably increase the operating strokes of the pistons 33 of the cylinders 32 beyond the optimum value Xav.

In the present embodiment, therefore, the initial hydraulic pressure Pss can be set to be comparatively low, for example, at a level slightly higher than the atmospheric pressure, provided the set initial hydraulic pressure Pss is sufficient to permit the pistons 33 of all the used hydraulic cylinders 32 to be held at their upper stroke ends while supporting the pressure ring 30 through the cushion pins 24. Since a small amount of variation in the initial hydraulic pressure Pss will not have a significant influence on the downward operating strokes of the pistons 33 of the hydraulic cylinders 32, it is not necessary to stringently or accurately control the initial hydraulic pressure Pss each time a pressing cycle is performed. It is possible to reduce the retracting stroke Sfe of the stepped piston 126 by an amount corresponding to an expect amount of change of the fluid volume which is caused by a change in the hydraulic pressure.

The hydro-pneumatic cylinder 116 functions as biasing means for biasing the stepped piston 126 toward the original position prior to a pressing operation on the machine 10. The hydro-pneumatic cylinder 116 has a piston 144, an oil chamber 146 formed on one side of the piston 144, and a gas chamber 148 formed on the other side of the piston 144. The oil chamber 146 is connected to the conduit 114 while the gas chamber 148 is charged with a suitable gas (nitrogen gas in this specific example) of a predetermined pressure. The gas pressure in the gas chamber 148 is determined so that prior to a pressing operation on the blank 29, the gas pressure which acts on the piston 144 holds the piston 144 at its stroke end on the side of the oil chamber 146, whereby the stepped piston 126 of the free-piston cylinder 112 is held at the original or fully advanced position of FIG. 7, with the second chamber 132 being filled with the fluid introduced from the oil chamber 146 through the hole 130. When the hydraulic pressure in the hydraulic cylinders 32 and the connecting passage 42 is raised during a pressing operation on the blank 29, the stepped piston 126 is retracted from the original position while at the same time the piston 144 is moved toward the gas chamber 148 by the hydraulic pressure in the conduit 144, which is raised by the fluid discharged from the second chamber 132 through the hole 130. Namely, the oil chamber 146 absorbs a portion of the control fluid discharged from the second chamber 132 during movement of the stepped piston 126 from the original position during the pressing operation on the blank 29. The gas pressure in the gas chamber 148 is determined to permit the piston 144 to move toward the gas chamber 148 during the pressing operation on the blank 29.

Since the gas pressure P in the gas chamber 148 multiplied by the volume of the gas chamber 148 is constant, there exists a relationship as represented by the following equation (23):

$$Pgs \cdot Vgs = Pgx \cdot Vgx \quad (23)$$

where,

Vgs: Initial volume of the gas chamber 148;

Pgs: Initial gas pressure in the chamber 148;

Vgx: Volume of the chamber 148 when the slide plate 20 is at its lower stroke end; and Pgx: Gas pressure in the chamber 148 when the slide plate 20 is at its lower stroke end.

If a change in the volume of the fluid in the conduit 114 and second chamber 132 due to a change in the fluid pressure is ignored in the light of a small initial volume of the fluid in the conduit 114 and second chamber 132, the volume Vgx of the gas chamber 148 when the slide plate 20

(cushion platen 28) is located at its lower stroke end during a pressing operation on the blank 29 is represented by the following equation (24) which includes the pressure-receiving area Afe of the large-diameter portion 120 of the stepped piston 126 and the predetermined retracting stroke Sfe of the stepped piston 126.

$$Vgx=Vgs-Sfe\cdot Afe \quad (24)$$

The following equation (25) can be obtained from the above equations (23) and (24):

$$Pgs\cdot Vgs=Pgx(Vgs-Sfe\cdot Afe) \quad (25)$$

On the other hand, the initial gas pressure Pgs should be determined so as to satisfy the following equation (26), in order to hold the stepped piston 126 at the original position prior to a pressing operation on the blank 29:

$$Pgs>Pss \quad (26)$$

Further, the gas pressure Pgx during the pressing operation should be determined so as to satisfy the following equation (27), in order to permit the stepped piston 126 to be retracted by the distance Sfe during the pressing operation:

$$Psx>Pgx \quad (27)$$

The following equation (28) is obtained from the above equations (25) and (27):

$$Psx>Pgs\cdot Vgs/(Vgs-Sfe\cdot Afe) \quad (28)$$

Thus, the initial gas pressure Pgs can be set to be higher than the initial hydraulic pressure Pss, and so as to satisfy the above equation (28) in relation to the initial gas volume Vgs. The range of the initial gas pressure Pgs that can be set increases as the set initial hydraulic pressure Pss is lowered. Since the initial hydraulic pressure Pss can be set to be relatively low in the present embodiment, it is not necessary to accurately control the initial gas pressure Pgs each time a pressing cycle is performed. The initial hydraulic pressure in the conduit 114 is set to be higher than the initial hydraulic pressure Pss in the hydraulic cylinders 32 and passage 42, for example, set to be equal to the initial gas pressure Pgs.

In the present balancing apparatus 110, the initial volume Vs of the working fluid in the hydraulic cylinders 32 and connecting passage 42 is relatively small, and a relatively small amount of change of the fluid volume will cause a relatively large amount of change of the hydraulic pressure. The present balancing apparatus 110 is therefore capable of establishing the desired hydraulic pressure Psx with a small amount of change ΔVs of the fluid volume, even in the presence of some variation in the compressibility or modulus K of elasticity of volume of the working fluid, which may occur due to a change in the temperature of the fluid and a varying amount of air included in the fluid. According to the present apparatus 110, the variation in the modulus K of elasticity of volume of the working fluid will not deteriorate the even distribution of the blank-holding force.

Further, it is not necessary to accurately control the initial hydraulic pressure Pss each time a pressing cycle is performed, since the relatively small initial volume Vs of the fluid in the hydraulic cylinders 32 and connecting passage 42 permits a relatively large amount of change of the hydraulic pressure with a relatively small amount of change of the fluid volume. In addition, the initial hydraulic pressure Pss can be set to be as low as the atmospheric pressure or so. Different pressing operations with different optimum blank-holding forces can be performed without changing the initial hydraulic pressure Pss and initial gas pressure Pgs which have been set.

As the pressure ring 30 is moved down during a pressing operation on the blank 29, the pistons 33 of the hydraulic cylinders 32 are moved down until the force based on the hydraulic pressure in the hydraulic cylinder 32 is balanced with the force based on the pneumatic pressure in the pneumatic cylinder 34, whereby the blank-holding force generated by the cushioning pneumatic cylinder 34 is evenly distributed. A further movement of the pressure ring 30 causes a further increase in the pressure in the pneumatic cylinder 34, and an increase in the blank-holding force and an increase in the pressure in the hydraulic cylinders whereby the pistons 33 of the hydraulic cylinders 32 are further moved down. In the present balancing apparatus 110 in which the initial volume Vs of the fluid in the cylinders 32 and passage 42 is relatively small, the amount of reduction of the fluid volume which is inversely proportional with the blank-holding force is relatively small, and therefore the amount of movement of the pistons 33 of the hydraulic cylinders 32 corresponding to the increase in the blank-holding force is considerably small, whereby the bottoming of the pistons 33 is prevented, and the axial dimension of each hydraulic cylinder 32 can be made relatively small.

Since the free-piston cylinder 112 and the hydro-pneumatic cylinder 116 of the discharge control means 118 are disposed on the cushion platen 28, together with the multiple hydraulic cylinders 32, the pressing machine 10 can be made compact as a whole, and the distance of the fluid flow during a pressing operation can be reduced, whereby the amount of heat generated by the fluid flow resistance is accordingly reduced.

The distance of retracting movement of the stepped piston 126 of the free-piston cylinder 112 is limited to Sfe by a rise of the hydraulic pressure within the second chamber 132, and the flow of the fluid from the connecting passage 42 into the first chamber 128 of the cylinder 112 is stopped when the retracting stroke of the stepped piston 126 reaches the predetermined value Sfe. In this respect, the vibration of the stepped piston 126 is smaller than that of the hydro-pneumatic cylinder 56 used in the first embodiment. Accordingly, the hydraulic pressure pulsation caused by the stepped piston 126 is effectively minimized.

While the present invention has been described in detail by reference to the accompanying drawings, it is to be understood that the invention may be otherwise embodied.

In the fourth and fifth embodiments of FIGS. 4 and 5, all of the hydro-pneumatic cylinders 92 have the same dimensions. It is possible, however, the hydro-pneumatic cylinders 92 have different ratios of the pressure-receiving areas on the oil and air chamber sides, and/or different initial air volumes Vv of the air chamber. If the hydro-pneumatic cylinders 92 in the embodiment of FIG. 5 have different pressure-receiving area ratios and/or different initial air volumes Vv, the balancing apparatus 100 is capable of dealing with an increased number of different pressing conditions which correspond to respective combinations of the ratios, air volumes Vs, and initial air pressure Pvs which can be adjusted by the solenoid-operated shut-off valves 104.

The hydro-pneumatic cylinders 92 used in the embodiments of FIGS. 4 and 5 may be replaced by the discharge control cylinders 82 of FIGS. 3(*a*) using the spring 80 as biasing means, or the discharge control cylinders 86 of FIG. 3(*b*) using the mechanical stopper 84. Where the discharge control cylinders 82 are used, it is desirable to provide suitable means such as a screw for adjusting the initial amount lo of compressive deformation of the spring 80.

While the illustrated embodiments are adapted such that the initial air pressure Pvs is determined according to the predetermined equation, the initial air pressure Pvs may be adjusted by test pressing operations, so as to permit even distribution of the blank-holding force, by changing the initial air pressure Pvs after the other physical parameters are adjusted to the predetermined values. In place of the initial air pressure Pvs, the air pressure Pvx when the cushion platen 28 is located at its lower stroke end may be adjusted. In this case, the pressing machine 10 test-operated with a given value of the air pressure Pvx is stopped when the slide plate 20 (cushion platen 28) is at its lower stroke end, and the hydraulic pressure Psx or retracting stroke Sr of the piston of the discharge control means is checked to see if the blank-holding force is evenly distributed. The test pressing operation of the machine 10 is repeated with different values of the air pressure Pvx, until the blank-holding force is evenly distributed.

Although the initial hydraulic pressure Pss and initial air pressure Pvs are automatically controlled or adjusted by the solenoid-operated shut-off valves 50, 76 under the control of the controller 54 in the illustrated embodiments, these parameters Pss, Pvs may be manually adjusted by the operator of the machine 10 by using manually operated shut-off valves and control switches. Similarly, manually operated shut-off valves may be provided in addition to, or in place of the solenoid-operated shut-off valves 102, 104 used in the embodiment of FIG. 5.

It is to be understood that the present invention may be embodied with various other changes, modifications and improvements, which may occur to those skilled in the art.

What is claimed is:

1. A balancing apparatus for a pressing machine for performing a pressing operation on a blank, comprising:

force generating means including a cushioning pneumatic cylinder for generating a blank-holding force during said pressing operation for holding said blank;

a plurality of balancing hydraulic cylinders having respective oil chambers communicating with each other and including respective pistons that are moved to neutral positions thereof during the pressing operation, for evenly distributing said blank-holding force;

a connecting passage connecting said oil chambers of said balancing hydraulic cylinders to each other; and discharge control means connected to said connecting passage, for inhibiting, prior to said pressing operation, a discharge flow of a working fluid from said balancing hydraulic cylinders and thereby holding said pistons of all of the balancing hydraulic cylinders at upper stroke ends thereof, and for permitting, during said pressing operation, said discharge flow of the working fluid, thereby to permit said pistons to be moved to said neutral positions for even distribution of said blank-holding force;

said discharge control means comprising at least one discharge control cylinder to provide a chamber having a volume variable by an amount corresponding to the volume of working fluid discharged during movement of said pistons from the upper stroke ends thereof to said neutral positions.

2. A balancing apparatus according to claim 1, further comprising a cushion platen on which said balancing hydraulic cylinders are disposed, a pressure member for holding said blank with said blank-holding force during said pressing operation on said blank, and a plurality of cushion pins having upper ends supporting said pressure member and lower ends associated with said pistons of said plurality of balancing hydraulic cylinders, respectively, and wherein said cushioning pneumatic cylinder supports said cushion platen and generates said blank-holding force during said pressing operation, said blank-holding force generated by said cushioning pneumatic cylinder being transferred to said pressure member through said cushion platen, said balancing hydraulic cylinders and said cushion pins, for holding said blank.

3. A balancing apparatus for a pressing machine, including force generating means for generating a force during a pressing operation, and a plurality of balancing hydraulic cylinders having respective oil chambers communicating with each other and including respective pistons that are moved to neutral positions thereof during the pressing operation, for evenly distributing said force, said balancing apparatus comprising:

a connecting passage connecting said oil chambers of said balancing hydraulic cylinders to each other;

discharge control means connected to said connecting passage, for inhibiting, prior to said pressing operation, a discharge flow of a working fluid from said balancing hydraulic cylinders and thereby holding said pistons of all of the balancing hydraulic cylinders at upper stroke ends thereof, and for permitting, during said pressing operation, said discharge flow of the working fluid, thereby to permit said pistons to be moved to said neutral positions;

a cushion platen on which said balancing hydraulic cylinders are disposed;

a pressure member for holding a blank during said pressing operation on said blank; and a plurality of cushion pins having upper ends supporting said pressure member and lower ends associated with said pistons of said plurality of balancing hydraulic cylinders, respectively;

said force generating means comprising a cushioning pneumatic cylinder supporting said cushion platen and generating a blank-holding force during said pressing operation, said blank-holding force being transferred to said pressure member through said cushion platen, said balancing hydraulic cylinders and said cushion pins, for holding said blank; and said discharge control means being disposed on said cushion platen together with said balancing hydraulic cylinders.

4. A balancing apparatus for a pressing machine, including force generating means for generating a force during a pressing operation, and a plurality of balancing hydraulic cylinders having respective oil chambers communicating with each other and including respective pistons that are moved to neutral positions thereof during the pressing operation, for evenly distributing said force, said balancing apparatus comprising:

a connecting passage connecting said oil chambers of said balancing hydraulic cylinders to each other; and discharge control means connected to said connecting passage, for inhibiting, prior to said pressing operation, a discharge flow of a working fluid from said balancing hydraulic cylinders and thereby holding said pistons of all of the balancing hydraulic cylinders at upper stroke ends thereof, and for permitting, during said pressing operation, said discharge flow of the working fluid, thereby to permit said pistons to be moved to said neutral positions;

said discharge control means comprising a plurality of discharge control cylinders disposed in parallel connection with each other and connected to said connecting passage, each of said discharge control cylinders including a piston and elastic means for producing a biasing force for biasing said piston so as to hold said piston at an original position thereof prior to said pressing operation, said piston receiving a hydraulic pressure in said balancing hydraulic cylinders through said connecting passage so that said piston is moved from said original position against a biasing force of said elastic means when said hydraulic pressure is raised during said pressing operation, whereby said discharge control cylinders permit said discharge flow of the working fluid from said balancing hydraulic cylinders into said discharge control cylinders through said connecting passage, by an amount corresponding to a distance of movement of said piston from said original position, during said pressing operation.

5. A balancing apparatus according to claim 4, wherein said plurality of discharge control cylinders consist of a plurality of hydro-pneumatic cylinders each of which includes a piston having opposite surfaces which partially define an oil chamber and an air chamber, said oil chamber communicating with said connecting passage, and said air chamber being filled with compressed air which functions as said elastic means.

6. A balancing apparatus according to claim 5, further comprising biasing force adjusting means for adjusting an initial pressure of said compressed air.

7. A balancing apparatus according to claim 4, wherein each of said plurality of discharge control cylinders includes a piston having a pressure-receiving surface which receives said hydraulic pressure, said elastic means comprising a spring which biases said piston in a direction toward said original position.

8. A balancing apparatus according to claim 4, wherein each of said plurality of discharge control cylinders includes a piston having opposite surfaces which partially define an oil chamber communicating with said connecting passage, and an air chamber charged with a compressed gas which functions as said elastic means.

9. A balancing apparatus for a pressing machine, including force generating means for generating a force during a pressing operation, and a plurality of balancing hydraulic cylinders having respective oil chambers communicating with each other and including respective pistons that are moved to neutral positions thereof during the pressing operation, for evenly distributing said force, said balancing apparatus comprising:

a connecting passage connecting said oil chambers of said balancing hydraulic cylinders to each other; and discharge control means connected to said connecting passage, for inhibiting, prior to said pressing operation, a discharge flow of a working fluid from said balancing hydraulic cylinders and thereby holding said pistons of all of the balancing hydraulic cylinders at upper stroke ends thereof, and for permitting, during said pressing operation, said discharge flow of the working fluid, thereby to permit said pistons to be moved to said neutral positions;

said discharge control means comprising at least one discharge control cylinder connected to said connecting passage, each of said at least one discharge control cylinder including a piston and elastic means for producing a biasing force for biasing said piston so as to hold said piston at an original position thereof prior to said pressing operation, said piston receiving a hydraulic pressure in said balancing hydraulic cylinders through said connecting passage so that said piston is moved from said original position against a biasing force of said elastic means when said hydraulic pressure is raised during said pressing operation, said piston being moved to a position of equilibrium between said biasing force which increases as said elastic means is elastically deformed during a movement of said piston from said original position and a force based on said hydraulic pressure which corresponds to said force generated by said force generating means, said at least one discharge control cylinder permitting said discharge flow of the working fluid from said balancing hydraulic cylinders into said at least one discharge control cylinder through said connecting passage, by an amount corresponding to a distance of said movement of said piston from said original position, during said pressing operation.

10. A balancing apparatus according to claim 9, wherein each of said at least one discharge control cylinder consists of a hydro-pneumatic cylinder which includes a piston having opposite surfaces which partially define an oil chamber and an air chamber, said oil chamber communicating with said connecting passage, said oil chamber being filled with compressed air which functions as said elastic means.

11. A balancing apparatus according to claim 10, further comprising biasing force adjusting means for adjusting an initial pressure of said compressed air.

12. A balancing apparatus according to claim 9, wherein each of said at least one discharge control cylinder includes a piston having a pressure-receiving surface which receives said hydraulic pressure, said elastic means comprising a spring which biases said piston in a direction toward said original position.

13. A balancing apparatus according to claim 9, wherein each of said at least one discharge control cylinder includes a piston having opposite surfaces which partially define an oil chamber communicating with said connecting passage, and an air chamber charged with a compressed gas which functions as said elastic means.

14. A balancing apparatus according to claim 9, wherein said at least one discharge control cylinder consists of a plurality of discharge control cylinders which are disposed in parallel connection with each other, said plurality of discharge control cylinders having respective different relationships between said biasing force produced by said elastic means and said force based on said hydraulic pressure, said balancing apparatus further comprising selecting means for selectively enabling said plurality of cylinders to be operative, said plurality of discharge control cylinders being connected in parallel to said connecting passage.

15. A balancing apparatus according to claim 14, wherein said selecting means comprising shut-off valves which are connected to said plurality of discharge control cylinders, respectively, and to said connecting passage, said shut-off valves being selectively opened and closed to selectively enable said plurality of discharge control cylinders to be operative.

16. A balancing apparatus according to claim 14, wherein each of said plurality of discharge control cylinders consists of a hydro-pneumatic cylinder including a piston having opposite surfaces which partially define an oil chamber communicating with said connecting passage, and an air chamber filled with compressed air which functions as said elastic means, said balancing apparatus further comprising biasing force adjusting means for adjusting an initial pressure of said compressed air.

17. A balancing apparatus according to claim 16, further comprising shut-off valves which are connected to said plurality of discharge control cylinders, respectively, and to said biasing force adjusting means, said shut-off valves being selectively opened and closed to selectively enable the initial pressures of said compressed air in said air chambers of said discharge control cylinders to be adjusted independently of each other.

18. A balancing apparatus for a pressing machine, including force generating means for generating a force during a pressing operation, and a plurality of balancing hydraulic cylinders having respective oil chambers communicating with each other and including respective pistons that are moved to neutral positions thereof during the pressing operation, for evenly distributing said force, said balancing apparatus comprising:

a connecting passage connecting said oil chambers of said balancing hydraulic cylinders to each other; and discharge control means connected to said connecting passage, for inhibiting, prior to said pressing operation, a discharge flow of a working fluid from said balancing hydraulic cylinders and thereby holding said pistons of all of the balancing hydraulic cylinders at upper stroke ends thereof, and for permitting, during said pressing operation, said discharge flow of the working fluid, thereby to permit said pistons to be moved to said neutral positions;

said discharge control means comprising a discharge control cylinder device and biasing means connected to said discharge control cylinder device, said discharge control cylinder device including a cylinder body, and a stepped piston slidably and movably received within said cylinder body and having a large-diameter portion and a small-diameter portion, said large-diameter portion cooperating with said cylinder body to define a first chamber communicating with said connecting passage, said cylinder body cooperating with at least said small-diameter portion to define a second chamber filled with a control fluid which biases said stepped piston toward said first chamber so as to hold said stepped piston at an original position thereof prior to said pressing operation, and wherein said cylinder body has a hole which communicates at one end thereof with said second chamber when said stepped piston is placed in said original position, said hole being closed at said one end by said small-diameter portion when said stepped piston is moved by a predetermined distance from said original position toward said second chamber; and said biasing means being connected at the other end of said hole for introducing said control fluid into said second chamber through said hole so as to hold said stepped piston at said original position prior to said pressing operation, said biasing means permitting said stepped piston to be moved from said original position against a biasing force of said control fluid when a hydraulic pressure in said balancing hydraulic cylinders is raised during said pressing operation, said biasing means absorbing a portion of said control fluid discharged from said second chamber through said hole during a movement of said stepped piston from said original position.

19. A balancing apparatus according to claim 18, wherein said biasing means comprising a hydro-pneumatic cylinder having a piston having opposite surfaces which partially define an oil chamber communicating with said second chamber of said discharge control cylinder device, and a gas chamber charged with a compressed gas.

* * * * *